US007128282B2

(12) United States Patent
Okamoto et al.

(10) Patent No.: US 7,128,282 B2
(45) Date of Patent: Oct. 31, 2006

(54) FUEL INJECTION DEVICE OF INTERNAL COMBUSTION ENGINE

(75) Inventors: Atsuya Okamoto, Okazaki (JP); Nobuo Ota, Takahama (JP); Kouichi Mochizuki, Anjo (JP); Masuaki Iwamoto, Kariya (JP)

(73) Assignee: Denso Corporation (JP)

( * ) Notice: Subject to any disclaimer, the term of this patent is extended or adjusted under 35 U.S.C. 154(b) by 112 days.

(21) Appl. No.: 10/771,516

(22) Filed: Feb. 5, 2004

(65) Prior Publication Data

US 2004/0178287 A1 Sep. 16, 2004

(30) Foreign Application Priority Data

Feb. 5, 2003 (JP) ..... 2003-028151
Apr. 30, 2003 (JP) ..... 2003-124895

(51) Int. Cl.
*B05B 1/00* (2006.01)

(52) U.S. Cl. ..... 239/596; 239/494; 239/497; 239/533.12; 239/552; 239/556; 239/585.1; 239/585.5; 239/601

(58) Field of Classification Search ..... 239/494, 239/497, 533.12, 552, 556, 557, 558, 584, 239/585.1, 585.4, 585.5, 596–598, 601
See application file for complete search history.

(56) References Cited

U.S. PATENT DOCUMENTS 4,907,748 A 3/1990 Gardner et al.
5,244,154 A * 9/1993 Buchholz et al. ..... 239/596
5,492,277 A * 2/1996 Tani et al. ..... 239/585.5
5,636,796 A * 6/1997 Oguma ..... 239/533.12
5,685,485 A * 11/1997 Mock et al. ..... 239/596
5,931,391 A 8/1999 Tani et al.
6,439,484 B1 * 8/2002 Harata et al. ..... 239/596
2002/0008166 A1 1/2002 Fukaya et al.

FOREIGN PATENT DOCUMENTS

JP 11-200998 7/1999

* cited by examiner

*Primary Examiner*—Steven J. Ganey
(74) *Attorney, Agent, or Firm*—Nixon & Vanderhye PC

(57) ABSTRACT

Multiple injection holes are formed in an injection hole plate. Each injection hole penetrates the injection hole plate. The injection hole is formed with an inlet side opening and an outlet side opening. The outlet side opening is formed in the shape of a flattened rectangle having a major axis and a minor axis. Therefore, the fuel flowing into the injection hole through the inlet side opening is injected in the shape of a film from the outlet side opening. Thus, liquid film splitting is promoted, so atomization of the fuel is promoted. Since the multiple injection holes are formed in the injection hole plate, the shape of a great fuel spray, which is formed by combining fuel sprays injected from the respective injection holes, can be adjusted easily.

42 Claims, 21 Drawing Sheets

FUEL INJECTION DEVICE OF INTERNAL COMBUSTION ENGINE

CROSS REFERENCE TO RELATED APPLICATION

This application is based on and incorporates herein by reference Japanese Patent Applications No. 2003-28151 filed on Feb. 5, 2003 and No. 2003-124895 filed on Apr. 30, 2003.

BACKGROUND OF THE INVENTION

1. Field of the Invention

The present invention relates to a fuel injection device of an internal combustion engine.

2. Description of Related Art

A fuel injection valve for directly or indirectly injecting fuel into a combustion chamber of an internal combustion engine (an engine, hereafter) is publicly known. The fuel injected from the fuel injection valve is mixed with air in an air intake pipe or a combustion chamber and forms combustible mixture with the air. The mixture in the combustion chamber is compressed by a piston. Then, the mixture is ignited by an ignition plug and is combusted.

In the case of such a kind of engine, mixing performance between the fuel injected from the fuel injection valve and the air affects engine performance. Specifically, atomization of the fuel injected from the fuel injection valve is an important factor that affects the engine performance. A technology of disposing a plate, which is formed with multiple injection holes, at a tip end of a nozzle of the fuel injection valve is publicly known as disclosed in Japanese Patent Application Unexamined Publication No. H11-70347 (a patent document 1), for instance. By disposing the plate formed with the multiple injection holes at the tip end of the nozzle, the fuel flowing through a fuel passage formed between a valve member and a valve body is distributed to respective injection holes. Thus, the atomization of the fuel is promoted.

Recent years, regulations such as further reduction of harmful matters (for instance, nitrogen oxides) discharged from the engine have been strengthened. Therefore, the reduction of the harmful matters included in the exhaust gas is required than ever. However, it is difficult for the conventional atomization technology to respond to the recent strengthening of the exhaust gas regulations.

In a fuel injection valve disclosed in the patent document 1, an injection hole is formed in a cylindrical shape in a plate. Since the injection hole is formed in the cylindrical shape, a position for forming a fuel spray can be easily controlled. By arbitrarily adjusting the positions of the multiple injection holes formed in the plate, the fuel spray can be formed in a desired shape. In the case where the injection hole is formed in the cylindrical shape, the fuel injected from one injection hole forms a spray in a rod-like shape. Therefore, further atomization of the fuel is difficult.

SUMMARY OF THE INVENTION

It is therefore an object of the present invention to provide a fuel injection device capable of forming a fuel spray in a desired shape easily and of promoting further atomization of the fuel.

According to an aspect of the present invention, a fuel injection valve is formed with multiple injection holes. Therefore, positions for forming sprays injected from the respective injection holes can be adjusted arbitrarily by changing positions of the injection holes. Accordingly, the shape of a great spray formed of the sprays injected from the respective injection holes can be adjusted arbitrarily. Thus, the fuel spray in a desired shape can be formed easily. An outlet side opening of the injection hole is formed in a flattened shape having a major axis and a minor axis. Moreover, a sectional area of the injection hole gradually changes along a direction from an inlet side opening to the outlet side opening of the injection hole. Therefore, the fuel is injected as a spray in the shape of a film from the flattened outlet side opening. Therefore, liquid film splitting (splitting of the fuel spray in the shape of the film) is promoted and fuel atomization can be promoted further.

According to another aspect of the present invention, colliding means is disposed between a fuel inlet and a fuel outlet of the injection hole. The fuel flowing into the injection hole from the fuel inlet collides with the colliding means. Then, the fuel is injected from the fuel outlet. Since the fuel flowing into the injection hole collides with the colliding means, the fuel is broken into minute liquid droplets. Thus, kinetic energy of the fuel is converted into atomization energy through the collision between the fuel and the colliding means. Thus, the atomization of the fuel can be promoted further. Moreover, control of the fuel spray is facilitated owing to the colliding means.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF THE REFERRED EMBODIMENT (First Embodiment)

Figure 1:
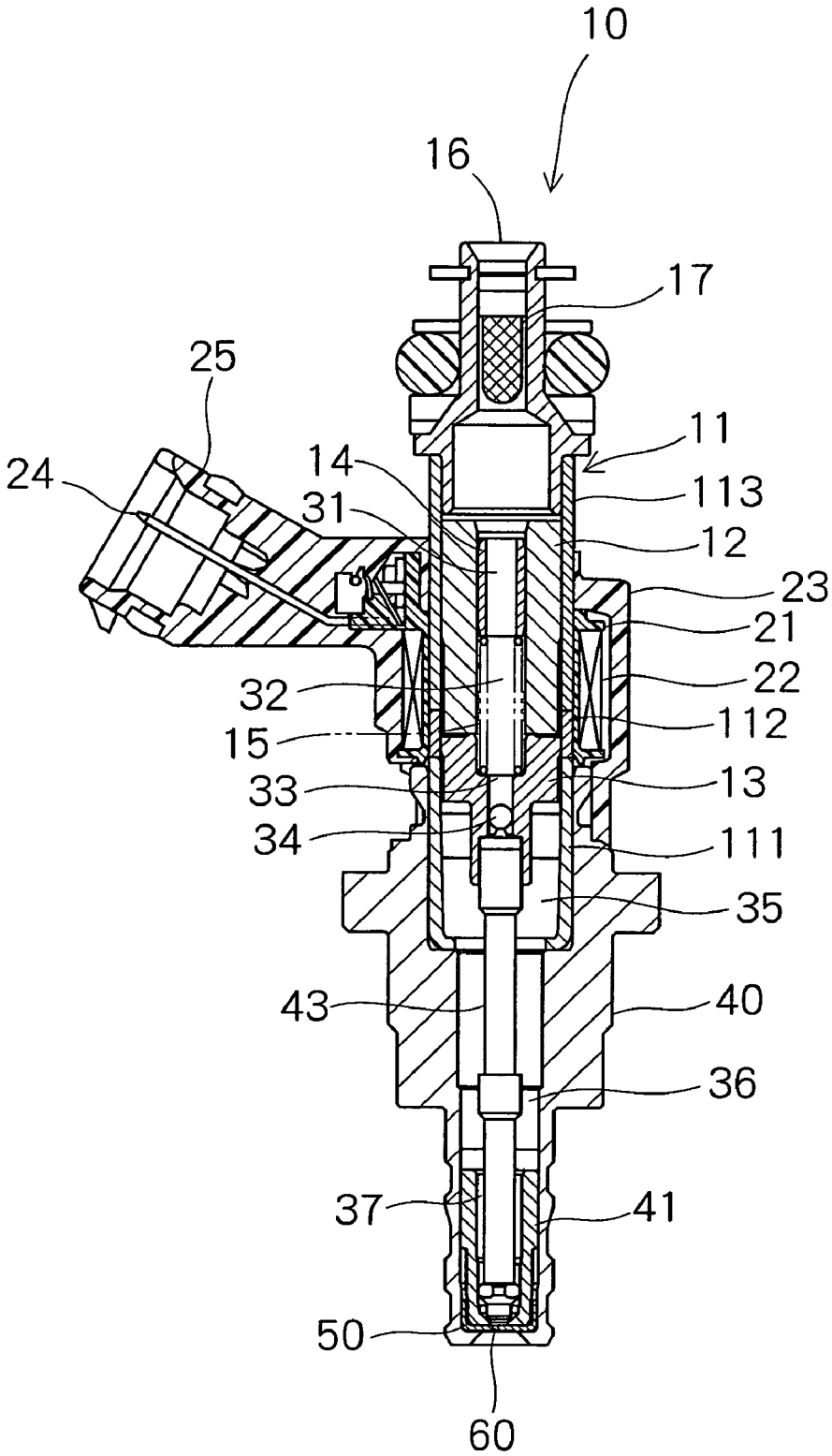
FIG. 1 is a sectional view showing an injector according to a first embodiment of the present invention.

Referring to FIG. 1, a fuel injection valve (an injector, hereafter) 10 according to a first embodiment of the present invention is illustrated. The injector 10 according to the first embodiment is mounted in a cylinder head 3, which provides a combustion chamber 2 of a gasoline engine 1. More specifically, the injector 10 of the first embodiment is used in the direct-injection type gasoline engine 1, which injects the fuel directly into the combustion chamber 2. The injector 10 can be used in a premix type gasoline engine, which injects the fuel into intake air flowing through an air intake pipe 4 connected to the combustion chamber 2. The injector 10 can be used in a diesel engine also.

As shown in FIG. 1, a housing 11 of the injector 10 is formed in a cylindrical shape. The housing 11 has a first magnetic portion 111, a non-magnetic portion 112 and a second magnetic portion 113, which are disposed coaxially with each other. The non-magnetic portion 112 prevents a magnetic short circuit between the first and second magnetic portions 111, 113. A fixed core 12 is formed of non-magnetic material in a cylindrical shape and is fixed on an inner peripheral surface of the housing 11 coaxially. A movable core 13 is formed of magnetic material in a cylindrical shape and is accommodated on an inner peripheral side of the housing 11. The movable core 13 can reciprocate on the inner peripheral side of the housing 11 in an axial direction.

A spool 21 is fitted around an outer periphery of the housing 11. A coil 22 is wound around the spool 21. Outer peripheries of the spool 21 and the coil 22 are covered by a resin mold 23. The resin mold 23 has a connector 25, in which a terminal 24 is embedded. The coil 22 is electrically connected with the terminal 24 of the connector 25. If the coil 22 is energized through the terminal 24, a magnetic attractive force is generated between the fixed core 12 and the movable core 13.

An adjusting pipe 14 is press-fitted to the inner peripheral surface of the fixed core 12. An inner peripheral surface of the adjusting pipe 14 provides a fuel passage 31. An end of the adjusting pipe 14 on the movable core 13 side contacts a spring 15. An end of the spring 15 contacts the adjusting pipe 14 and the other end of the spring 15 contacts the movable core 13. Thus, the spring 15 biases the movable core 13 in a direction opposite from the fixed core 12, or a direction for separating the movable core 13 from the fixed core 12. Load of the spring 15 for biasing the movable core 13 is adjusted by regulating a press-fitting degree of the adjusting pipe 14.

The housing 11 has a fuel inlet 16 to which the fuel is supplied from a fuel tank. The fuel flowing through the inlet 16 flows into the inner peripheral side of the housing 11 through a filter 17. The filter 17 eliminates extraneous matters included in the fuel.

A nozzle holder 40 is formed in a cylindrical shape and is connected to an end of the housing 11. A valve body 41 is fixed to an inner peripheral surface of the nozzle holder 40. The valve body 41 is formed in a cylindrical shape and is fixed to the nozzle holder 40 through press-fitting or welding, for instance. A valve seat 42 in a conical shape is formed in the inner peripheral surface of the valve body 41. An internal diameter of the valve seat 42 decreases toward a tip end of the valve body 41. An injection hole plate 50 is disposed between an end of the valve body 41 on its tip end side and the nozzle holder 40. Multiple injection holes 60 are formed in the injection hole plate 50.

Figure 3:
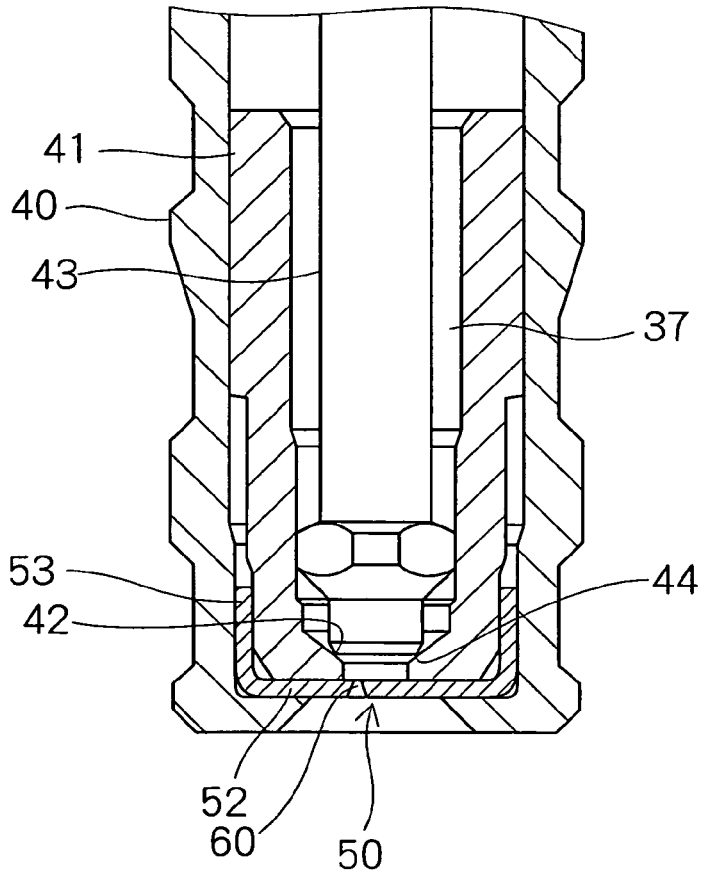
FIG. 3 is a sectional diagram showing a substantial part of the injector according to the first embodiment.

A needle 43 as a valve member is accommodated on the inner peripheral sides of the housing 11, the nozzle holder 40 and the valve body 41 so that the needle 43 can reciprocate in the axial direction as shown in FIG. 1. An end of the needle 43 is connected to the movable core 13. Thus, the needle 43 can reciprocate integrally with the movable core 13 in the axial direction. A contacting portion 44 capable of being seated on the valve seat 42 of the valve body 41 is formed on the end of the needle 43 on a side opposite from the movable core 13 as shown in FIG. 3. The contacting portion 44 and the valve seat 42 provide a valve portion capable of intermitting the flow of the fuel.

As shown in FIG. 1, the fuel flowing from the fuel inlet 16 into the inner peripheral side of the housing 11 flows into a fuel passage 33 formed on the inner peripheral side of the movable core 13 through the filter 17, a fuel passage 31 formed on the inner peripheral side of the adjusting pipe 14 and a fuel passage 32 formed on the inner peripheral side of the fixed core 12. The fuel in the fuel passage 33 flows into a fuel passage 35 provided between the housing 11 and the needle 43 through a fuel hole 34 connecting the inner periphery and the outer periphery of the movable core 13 with each other. The fuel in the fuel passage 35 flows into a fuel passage 37 formed between the valve body 41 and the needle 43 through a fuel passage 36 formed between the nozzle holder 40 and the needle 43.

When the coil 22 is not energized, the needle 43 and the movable core 13 are moved to a lower position in FIG. 1 by the biasing force of the spring 15. Therefore, the contacting portion 44 is seated on the valve seat 42. As a result, the flow of the fuel from the fuel passage 37 to the injection holes 60 is interrupted and the fuel is not injected.

If the coil 22 is energized, the magnetic attractive force is generated between the fixed core 12 and the movable core 13. Thus, the movable core 13 and the needle 43 integrated with the movable core 13 move upward (toward the fixed core 12) in FIG. 1 against the biasing force of the spring 15. Thus, the contacting portion 44 separates from the valve seat 42. As a result, the flow of the fuel from the passage 37 into the injection hole 60 is allowed. The fuel passing through an opening formed between the valve seat 42 of the valve body 41 and the contacting portion 44 of the needle 43 is injected into the combustion chamber 2 of the gasoline engine 1 shown in FIG. 2 through the injection holes 60 formed in the injection hole plate 50.

If the energization to the coil 22 is stopped, the magnetic attractive force between the fixed core 12 and the movable core 13 disappears. Thus, the movable core 13 and the needle 43 integrated with the movable core 13 are moved downward in FIG. 1 by the biasing force of the spring 15. Thus, the contacting portion 44 is seated on the valve seat 42 again. As a result, the flow of the fuel from the fuel passage 37 to the injection holes 60 is interrupted and the injection of the fuel is ended.

Next, the injection hole 60 formed in the injection hole plate 50 will be explained.

Figure 4A:
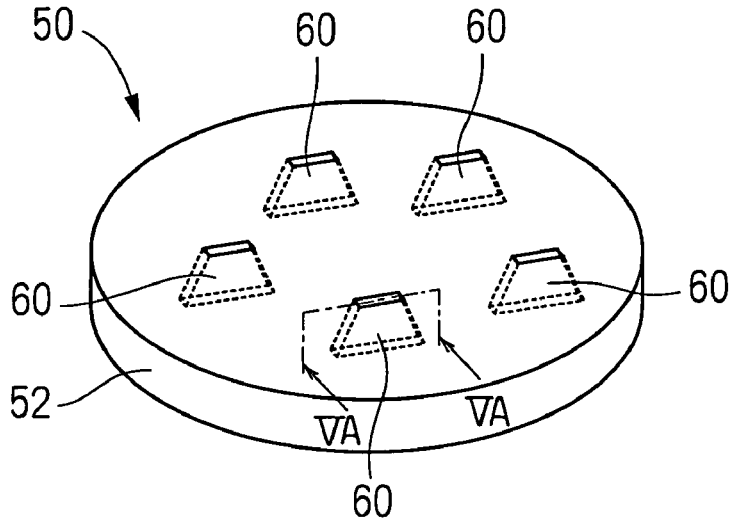
FIG. 4A is a perspective view showing a bottom portion of an injection hole plate of the injector according to the first embodiment.

As shown in FIG. 3, the injection hole plate 50 has a bottom portion 52 and a side portion 53, or the injection hole plate 50 is formed in the shape of a cylinder with a bottom. The bottom portion 52 of the injection hole plate 50 is interposed between an outer wall surface of the valve body 41 on a side opposite from the fixed core 12 and an inner wall surface of the nozzle holder 40. The side portion 53 of the injection hole plate 50 is interposed between an outer peripheral wall surface of the valve body 41 and an inner peripheral wall surface of the nozzle holder 40. The multiple injection holes 60 are formed in the bottom portion 52 as shown in FIG. 4A. The multiple injection holes 60 can be positioned arbitrarily. The multiple injection holes 60 can be positioned so that the fuel injected from the respective injection holes 60 forms sprays in desired shapes in accordance with desired performance of the gasoline engine 1, for instance.

Each injection hole 60 penetrates the bottom portion 52 of the injection hole plate 50 in its thickness direction. The injection hole 60 has an inlet side opening 61 at its end on a nozzle holder 40 side (a valve seat 42 side) and an outlet side opening 62 at its end on a side opposite from the nozzle holder 40 (a side opposite from the valve seat 42). The inlet side opening 61 is formed in the shape of a flattened rectangle having a major axis and a minor axis. Likewise, the outlet side opening 62 is formed in the shape of a rectangle having a major axis and a minor axis. Thus, a section of the injection hole 60 perpendicular to its central axis is formed in the shape of a rectangle.

Figure 4B:
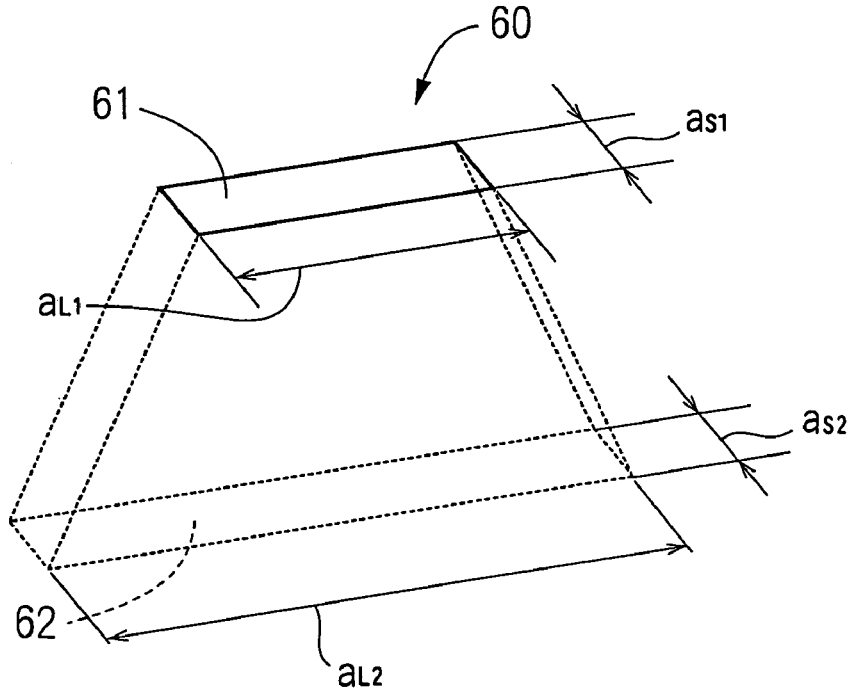
FIG. 4B is an enlarged perspective view showing an injection hole of the injector according to the first embodiment.

As shown in FIG. 4B, in the first embodiment, the major axis $a_{L1}$ of the inlet side opening 61 is shorter than the major axis $a_{L2}$ of the outlet side opening 62. The minor axis $a_{S1}$ of the inlet side opening 61 substantially coincides with the minor axis $a_{S2}$ of the outlet side opening 62. A sectional area of the injection hole 60 gradually changes along a direction from the inlet side opening 61 toward the outlet side opening 62. Therefore, the injection hole 60 is formed in the shape of a trapezoidal quadratic prism, whose section parallel to an axis of the injection hole plate 50 is formed in the shape of a trapezoid. A sectional area of the outlet side opening 62 is larger than a sectional area of the inlet side opening 61. More specifically, the sectional area of the injection hole 60 is gradually enlarged along the direction from the inlet side opening 61 to the outlet side opening 62.

Figure 5A:
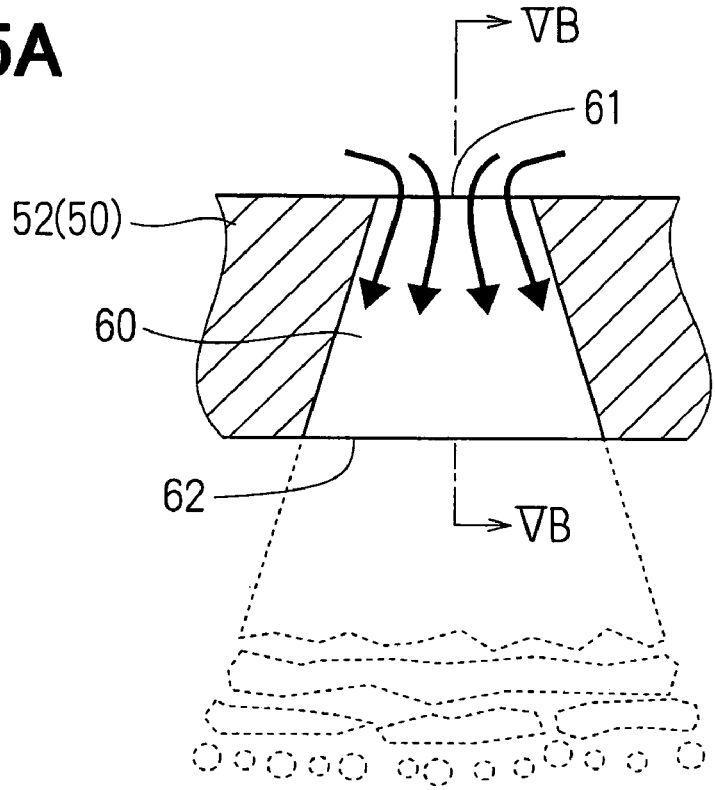
FIG. 5A is a sectional view showing the injection hole of the injection plate FIG. 4A along the arrow mark VA.
Figure 5B:
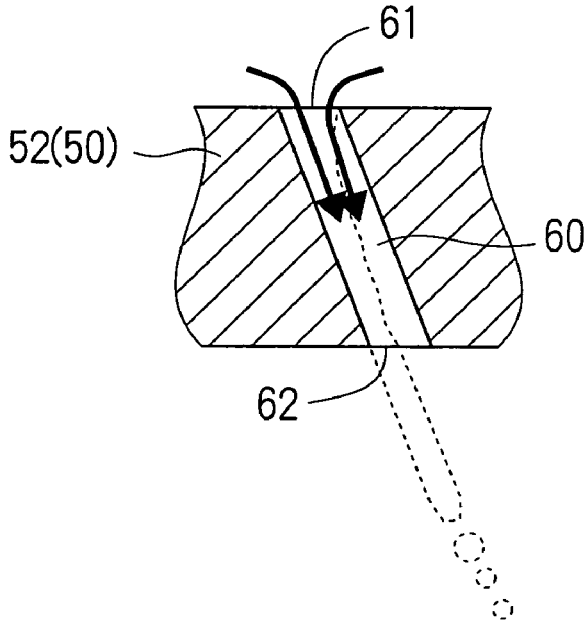
FIG. 5B is a sectional view showing the injection hole of FIG. 5A along the arrow mark VB.

Since the sectional area of the injection hole 60 is gradually enlarged along the direction from the inlet side opening 61 to the outlet side opening 62, the fuel in the shape of a liquid film is injected from each injection hole 60 of the injection hole plate 50 as shown in FIG. 5A. Therefore, the fuel injected from the injection hole 60 causes liquid film splitting. As a result, the fuel injected from each injection hole 60 of the injection hole plate 50 forms the fuel spray in the shape of a thin film.

In order to shape the fuel spray injected from the injection hole 60 into the thin film shape, at least the outlet side opening 62 of the injection hole 60 has to be shaped in a flattened shape. The inlet side opening 61 is not necessarily required to be similar to the outlet side opening 62. More specifically, as shown by a following formula (1), a ratio of the major axis $a_{L2}$ to the minor axis $a_{S2}$ of the outlet side opening 62 is greater than a ratio of the major axis $a_{L1}$ to the minor axis $a_{S1}$ of the inlet side opening 61.

$$(a_{L2}/a_{S2})>(a_{L1}/a_{S1}), \quad (1)$$

The multiple injection holes 60 are formed in the injection hole plate 50 as shown in FIG. 4A. Accordingly, the first phase fuel sprays injected from the multiple injection holes 60 form a greater second phase fuel spray as a whole. Therefore, by changing the arrangement of the injection holes 60, the shape of the second phase fuel spray formed by combining the first phase fuel sprays injected from the respective injection holes 60 can be easily adjusted.

In the first embodiment, the injection hole 60 is formed in the flattened shape and the sectional area of the injection hole 60 increases from the inlet side opening 61 to the outlet side opening 62. Therefore, the fuel injected from each injection hole 60 forms the fuel spray in the shape of the thin film. Therefore, the liquid film splitting is promoted in comparison with the case where the fuel is injected from an injection hole in the shape of a cylinder, for instance. Thus, the atomization of the fuel is promoted.

In the first embodiment, the multiple injection holes 60 are formed in the injection hole plate 50. Therefore, the first phase fuel sprays injected from the respective injection holes 60 are combined to form the greater second phase fuel spray. Therefore, by changing the arrangement of the injection holes 60, the second phase fuel spray can be formed in a desired shape easily. Moreover, the performance of the engine 1 employing the injector 10 can be improved by adjusting the shape of the second phase fuel spray into the desired shape.

Moreover again, in the first embodiment, collision between the fuel sprays injected from the adjacent injection holes 60 can be promoted by arranging the multiple injection holes 60 in close proximity to each other. The atomization of the fuel is improved further by promoting the collision among the fuel sprays.

(Second Embodiment)

Next, an injection hole plate 50 of an injector 10 according to the second embodiment will be explained based on FIG. 6.

Figure 6:
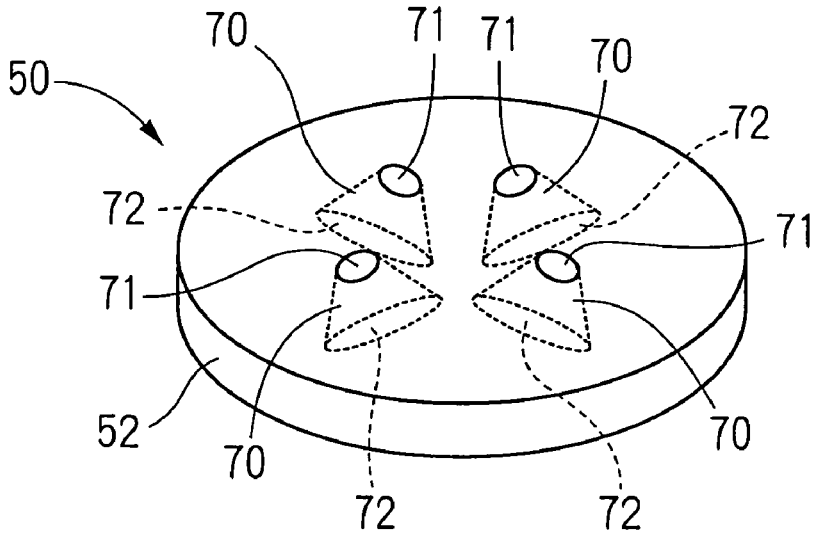
FIG. 6 is a perspective view showing an injection hole plate of an injector according to a second embodiment of the present invention.

As shown in FIG. 6, an inlet side opening 71 of an injection hole 70 is formed in the shape of a flattened ellipse having a major axis and a minor axis. Likewise, an outlet side opening 72 of the injection hole 70 is formed in the shape of a flattened ellipse having a major axis and a minor axis. Therefore, a section of the injection hole 70 perpendicular to its central axis is formed in the shape of an ellipse. The major axis of the inlet side opening 71 is shorter than the major axis of the outlet side opening 72. The minor axis of the inlet side opening 71 is longer than the minor axis of the outlet side opening 72. Alternatively, the minor axis of the inlet side opening 71 may be equal to or different from the minor axis of the outlet side opening 72. The sectional area of the injection hole 70 gradually changes along a direction from the inlet side opening 71 to the outlet side opening 72.

In the second embodiment, the fuel injected from the injection hole 70 forms a fuel spray in the shape of a film although the section of the injection hole 70 is formed in the shape of the ellipse. Therefore, the atomization of the fuel is promoted. Moreover, since the multiple injection holes 70 are formed, a shape of a second phase fuel spray formed by the first phase fuel sprays injected from the injection holes 70 can be changed easily.

(Third Embodiment)

Figure 7:
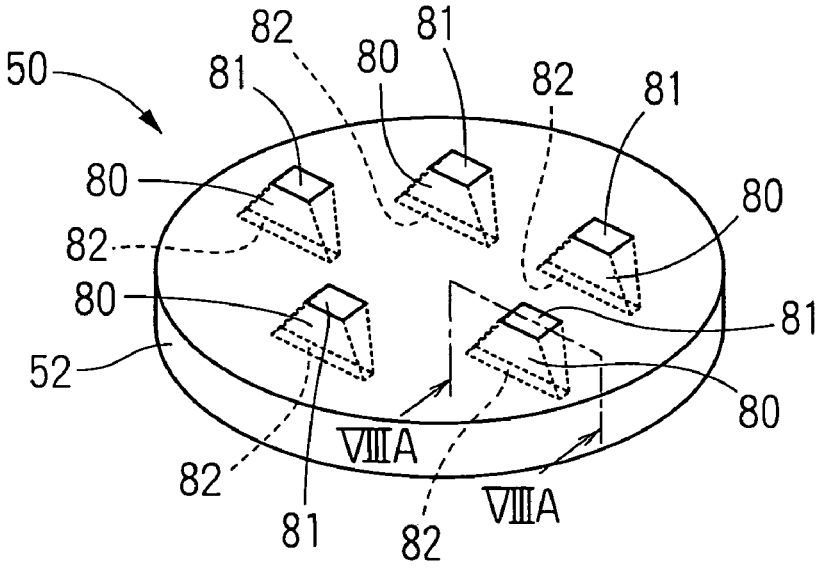
FIG. 7 is a perspective view showing an injection hole plate of an injector according to a third embodiment of the present invention.
Figure 8A:
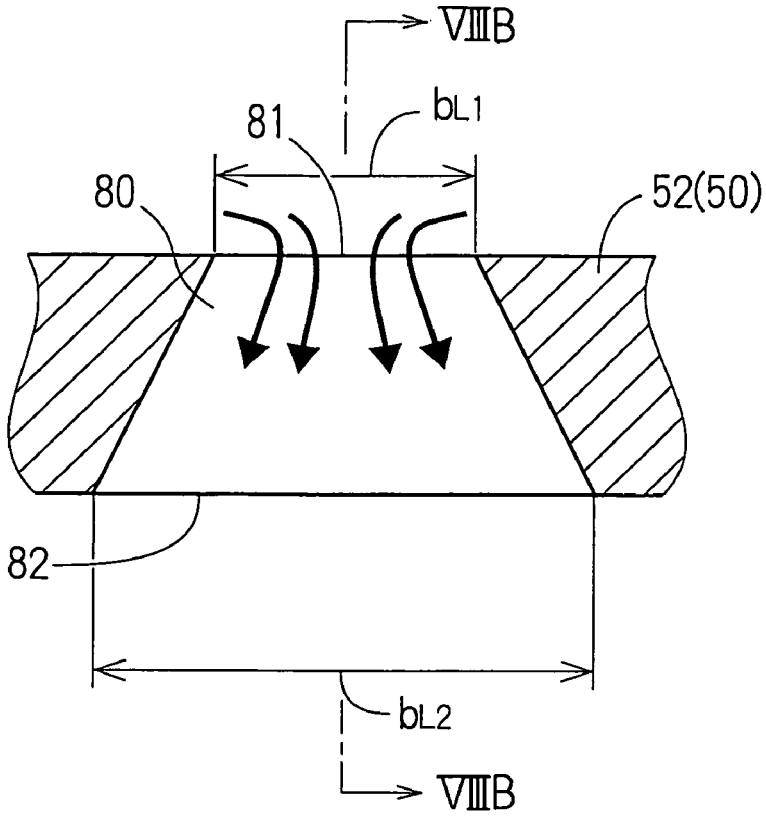
FIG. 8A is a sectional view showing an injection hole of the injection hole plate of FIG. 7 along the arrow mark VIIIA.
Figure 8B:
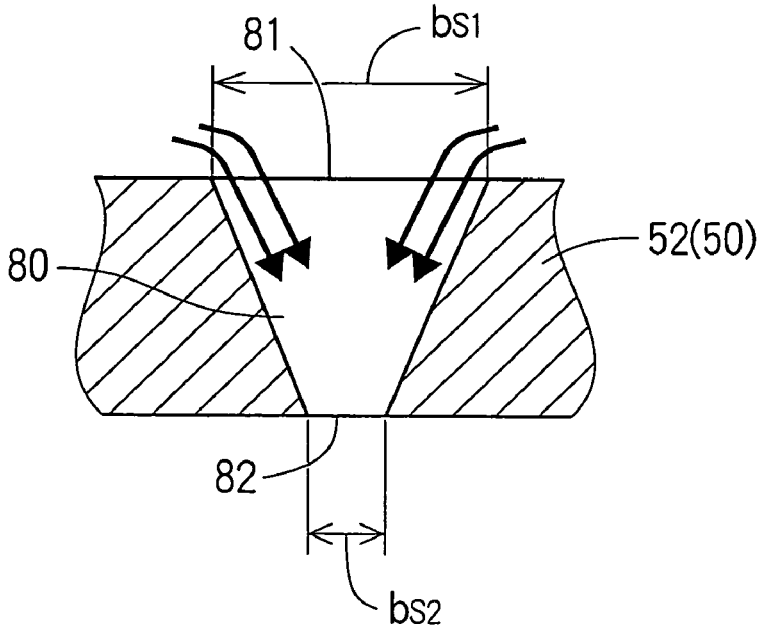
FIG. 8B is a sectional view showing the injection hole of FIG. 8A along the arrow mark VIIIB.

Next, an injection hole plate 50 of an injector 10 according to the third embodiment will be explained based on FIGS. 7 to 8B. In the third embodiment, an inlet side opening 81 of an injection hole 80 is formed in the shape of a flattened rectangle having a major axis $b_{L1}$ and a minor axis $b_{S1}$. Likewise, an outlet side opening 82 of the injection hole 80 is formed in the shape of a flattened rectangle having a major axis $b_{L2}$ and a minor axis $b_{S2}$. In the third embodiment, the major axis $b_{L1}$ of the inlet side opening 81 is shorter than the major axis $b_{L2}$ of the outlet side opening 82. The minor axis $b_{S1}$ of the inlet side opening 81 is longer than the minor axis $b_{S2}$ of the outlet side opening 82. A sectional area of the injection hole 80 changes along a direction from the inlet side opening 81 to the outlet side opening 82.

As explained in the first embodiment, if at least the outlet side opening 82 of the injection hole 80 is flattened, the atomization of the fuel spray is promoted. Therefore, if the outlet side opening 82 of the injection hole 80 is formed in the flattened shape, the shape of the inlet side opening 81 can be changed arbitrarily.

In the third embodiment, the area of the inlet side opening 81 is greater than the area of the outlet side opening 82. Therefore, the flow velocity of the fuel flowing inside the injection hole 80 is increased. As a result, the atomization of the fuel injected from the outlet side opening 82 is promoted further.

(Fourth Embodiment)

Next, an injection hole plate 50 of an injector 10 according to the fourth embodiment will be explained based on FIGS. 9 to 11.

Figure 9:
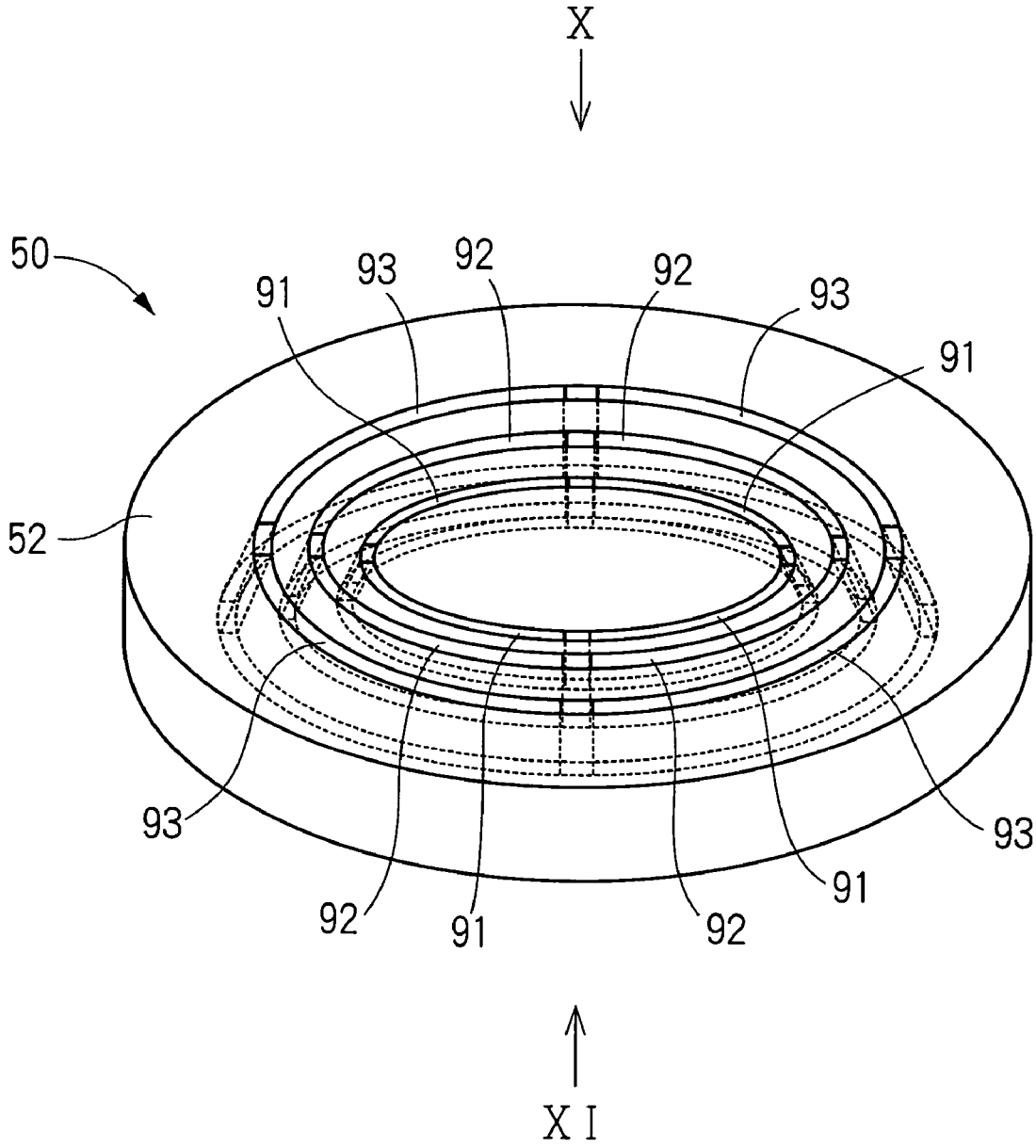
FIG. 9 is a perspective view showing an injection hole plate of an injector according to a fourth embodiment of the present invention.
Figure 10:
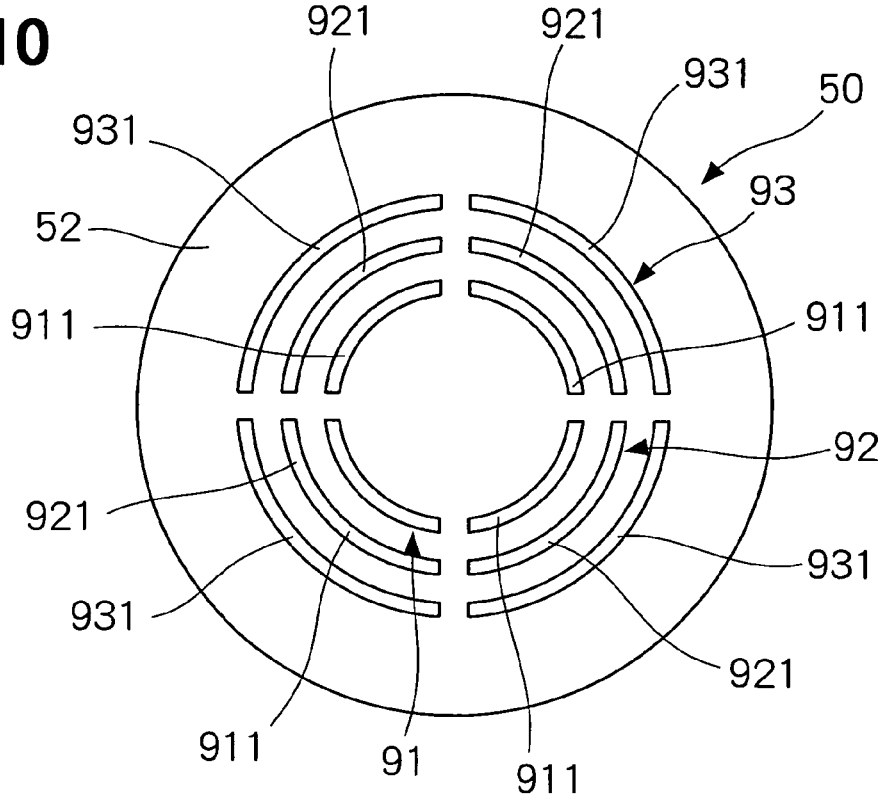
FIG. 10 is a view showing the injection hole plate of FIG. 9 along the arrow mark X.
Figure 11:
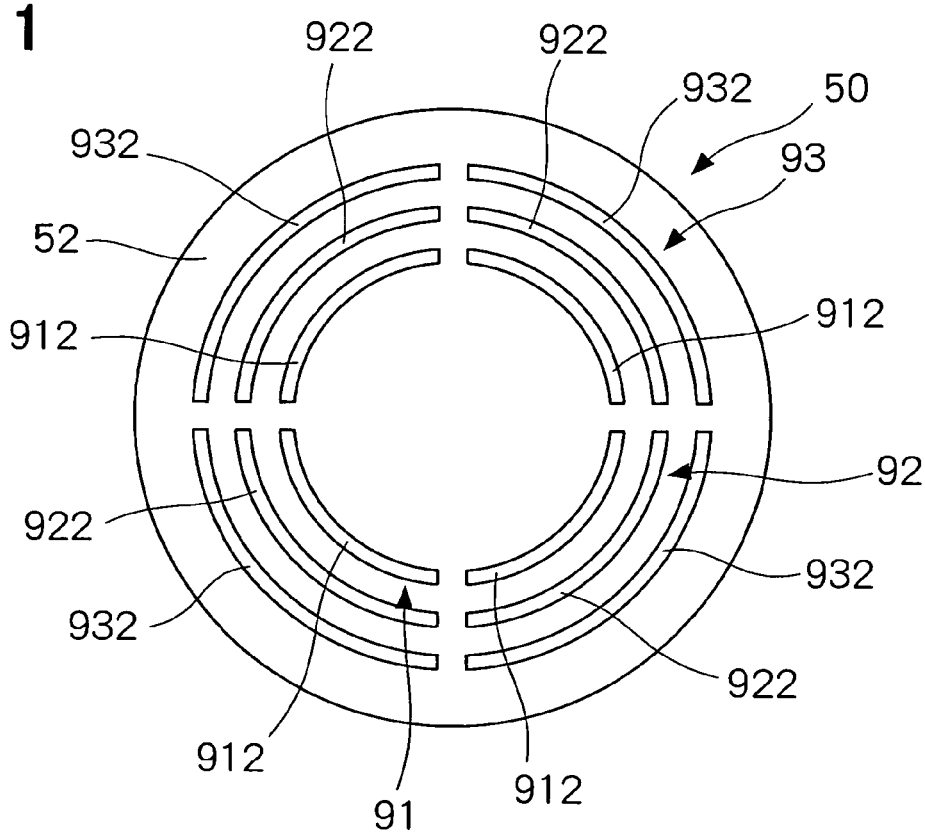
FIG. 11 is a view showing the injection hole plate of FIG. 9 along the arrow mark XI.

As shown in FIGS. 9 to 11, the injection hole plate 50 is formed with twelve injection holes 91, 92, 93 on circumferences of three concentric circles at regular intervals. More specifically, four injection holes are formed on the circumference of each circle at regular intervals. The four injection holes 91 formed on the radially most inner circle form a first injection hole group on a single circumference. Likewise, the four injection holes 92 formed on the circle radially outside the most inner circle form a second injection hole group on a single circumference. The four injection holes 93 formed on the most outer circle form a third injection hole group on a single circumference. The injection holes 91 of the first injection hole group, the injection holes 92 of the second injection hole group or the injection holes 93 of the third injection hole group are formed by dividing a hole in the shape of a truncated cone along the circumference into four portions. Thus, the injection holes 91 of the first injection hole group, the injection holes 92 of the second injection hole group or the injection holes 93 of the third injection hole group are formed in the shape of arcs and in the shape of a truncated cone as a whole. The injection holes 91 of the first injection hole group, the injection holes 92 of the second injection hole group or the injection holes 93 of the third injection hole group are formed substantially in the same shapes at regular circumferential intervals respectively.

As shown in FIG. 10, inlet side openings 911, 921, 931 of the injection holes 91, 92, 93 are formed in the shape of flattened arcs respectively having major axes, which extend circumferentially, and minor axes, which extend perpendicularly to the major axes and in radial directions of concentric circles. Likewise, outlet side openings 912, 922, 932 of the injection holes 91, 92, 93 are formed in the shape of flattened arcs respectively having major axes, which extend circumferentially, and minor axes, which extend perpendicularly to the major axes and in radial directions of concentric circles. The major axes of the inlet side openings 911, 921, 931 of the injection holes 91, 92, 93 are shorter than the major axes of the outlet side openings 921, 922, 932 respectively. The minor axes of the inlet side openings 911, 921, 931 substantially coincide with the minor axes of the outlet side openings 912, 922, 932 respectively. The injection holes 91, 92, 93 are formed in the shape of the truncated cones as a whole respectively. Therefore, sectional areas of the injection holes 91, 92, 93 change in directions from the inlet side openings 911, 921, 931 to the outlet side openings 912, 922, 932 respectively.

In the fourth embodiment, the injection holes 91, 92, 93 are formed with the outlet side openings 912, 922, 932 in the shape of the flattened arcs. Therefore, the injection holes 91, 92, 93 form sprays in the shape of films respectively. Therefore, the atomization of the fuel is promoted. By adjusting the intervals among the injection holes 91, 92, 93 or the number of the injection holes 91, 92, 93, the fuel sprays can be formed in demanded shapes corresponding to the engine 1 employing the injector 10.

In the fourth embodiment, four injection holes are formed on each one of the three concentric circles. The number of the circles is not limited to three if the number is greater than one. The number of the injection holes formed on one circle is not limited to four.

(Fifth Embodiment)

Figure 12:
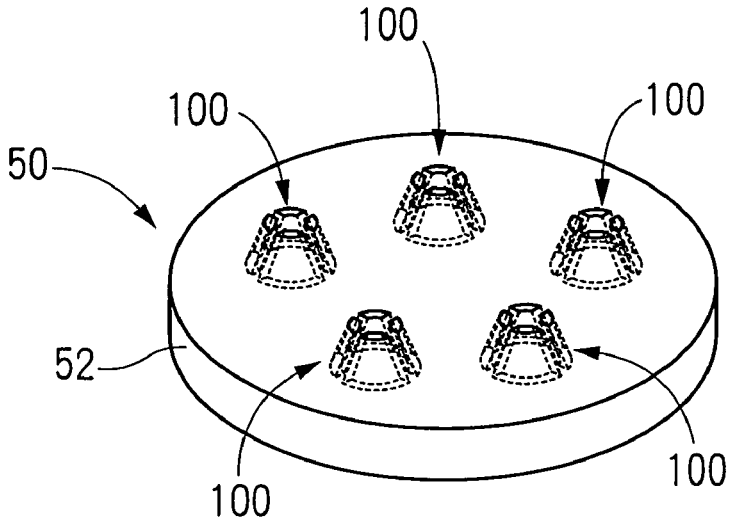
FIG. 12 is a perspective view showing an injection hole plate of an injector according to a fifth embodiment of the present invention.
Figure 13:
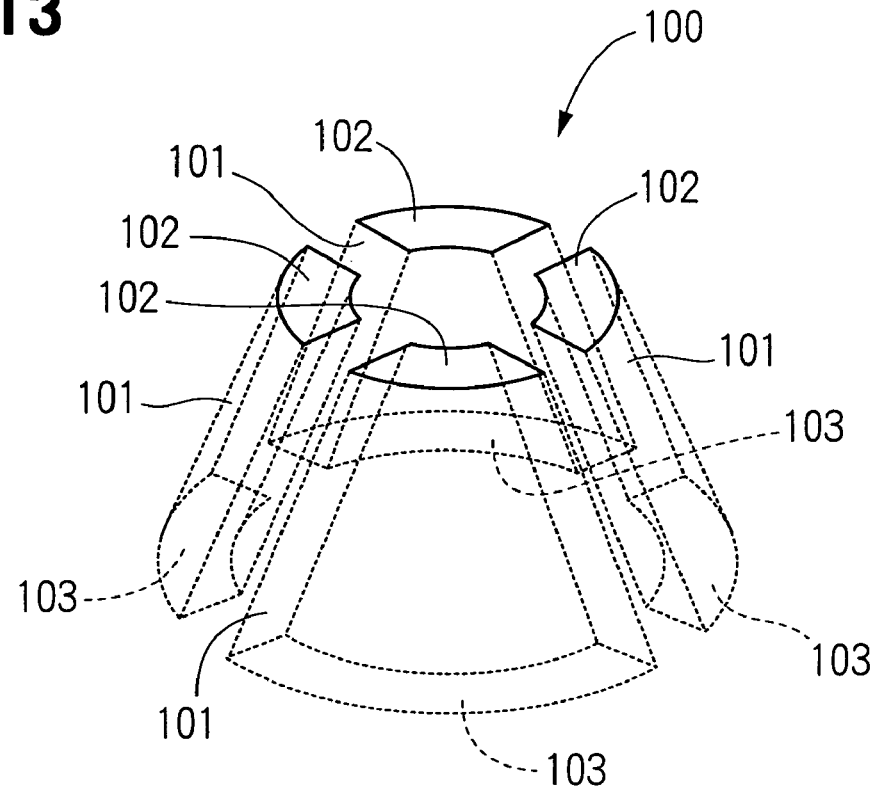
FIG. 13 is a perspective view showing an injection hole group of the injector according to the fifth embodiment.

Next, an injection hole plate 50 of an injector 10 according to the fifth embodiment will be explained based on FIGS. 12 and 13.

In the fifth embodiment, multiple injection hole groups 100 are formed in the injection hole plate 50. Each injection hole group 100 is formed of four injection holes 101. The four injection holes 101 of each injection hole group 100 are formed on the same circle at a predetermined interval along the circumference of the circle as shown in FIG. 13. The four injection holes 101 are formed by dividing a hole in the shape of a truncated cone along the circumference into four portions. Thus, the four injection holes 101 are formed in the shape of arcs and in the shape of a truncated cone as a whole. The shapes of the four injection holes 101 are generally the same. The four injection holes 101 forming the injection hole group 100 are formed with inlet side openings 102 and outlet side openings 103 respectively. The inlet side openings 102 are formed in the shape of flattened arcs respectively having major axes, which extend along circumferences of concentric circles, and minor axes, which extend perpendicularly to the major axes in radial directions of the concentric circles. Likewise, the outlet side openings 103 are formed in the shape of flattened arcs respectively having major axes, which extend along circumferences of concentric circles, and minor axes, which extend perpendicularly to the major axes in radial directions of the concentric circles. The major axis of the inlet side opening 102 of the injection hole 101 is shorter than the major axis of the outlet side opening 103. The minor axis of the inlet side opening 102 substantially coincides with the minor axis of the outlet side opening 103. The sectional area of the injection hole 101 gradually changes along a direction from the inlet side opening 102 to the outlet side opening 103.

In the fifth embodiment, a small first phase fuel spray is formed by the injection hole 101 forming the injection hole group 100. The small first phase fuel spray injected from the injection hole 101 is combined with the fuel spray injected form the other injection hole 101 of the same injection hole group 100 and forms a second phase fuel spray. Moreover, since the multiple injection hole groups 100 are formed in the injection hole plate 50, the second phase fuel sprays formed by the multiple injection hole groups 100 form a great third phase fuel spray. Therefore, the shape of the spray can be regulated more precisely by adjusting the arrangement of the injection hole groups 100 or the injection holes 101 or the number of the injection holes 101. Thus, the freedom of the shape of the fuel spray can be improved further.

(Sixth Embodiment)

Next, an injection hole plate 50 of an injector 10 according to the sixth embodiment will be explained based on FIGS. 14 and 15.

Figure 14:
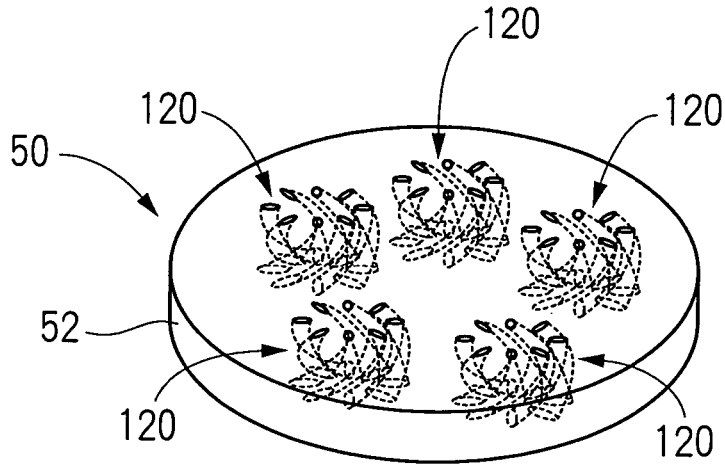
FIG. 14 is a perspective view showing an injection hole plate of an injector according to a sixth embodiment of the present invention.
Figure 15:
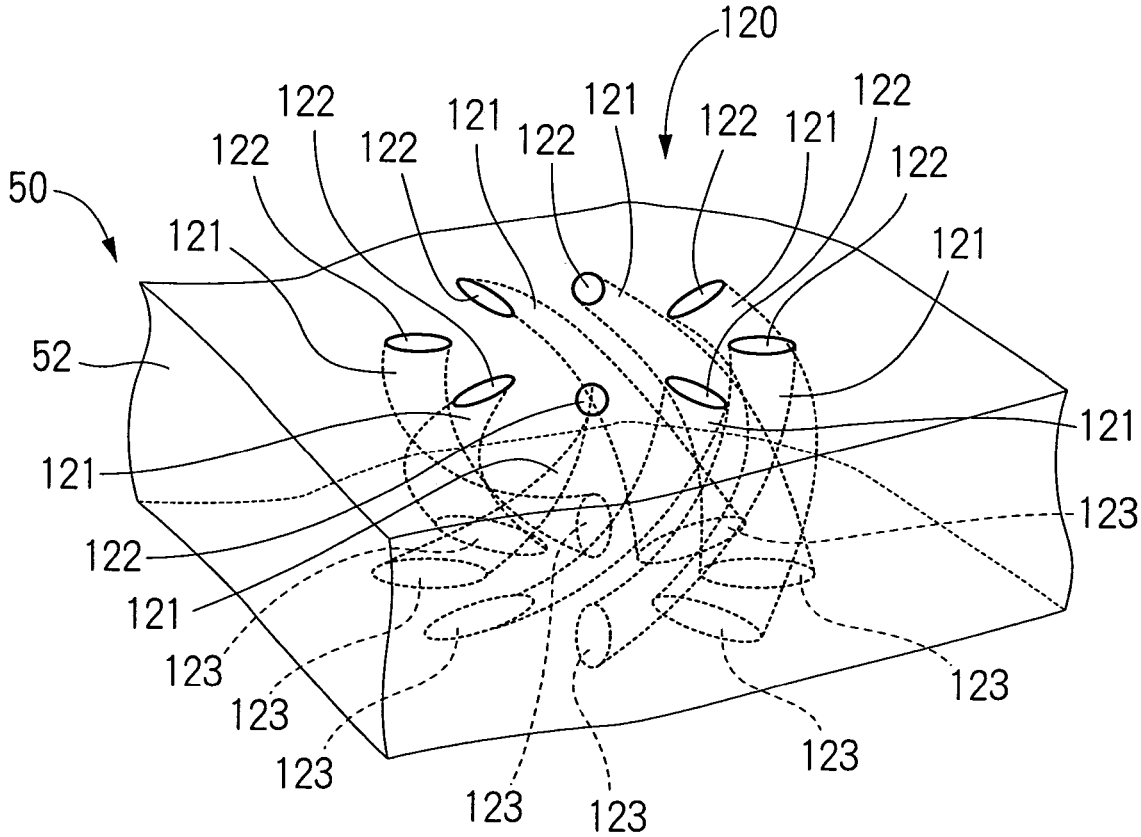
FIG. 15 is an enlarged perspective view showing an injection hole of the injector according to the sixth embodiment.

In the sixth embodiment, multiple injection hole groups 120 are formed in the injection hole plate 50 as shown in FIG. 14. Each injection hole group 120 is formed of multiple injection holes 121 disposed in a radial pattern as shown in FIG. 15. A section of each injection hole 121 is formed in the shape of a flattened ellipse. A major axis of an inlet side opening 122 of the injection hole 121 is shorter than a major axis of an outlet side opening 123.

In the sixth embodiment, the respective injection holes 121 forming the injection hole group 120 go around a virtual axis parallel to a central axis of the valve body 41. More specifically, each injection hole 121 forming the injection hole group 120 is formed in a spiral shape around the virtual axis. Therefore, a turning force is applied to the fuel flowing into the injection hole 121 through the inlet side opening 122. Thus, the atomization of the fuel is promoted further by the effect of the turning force applied to the fuel, in addition to the effect explained in the above embodiments.

(Seventh Embodiment)

Next, an injection hole plate 50 of an injector 10 according to the seventh embodiment will be explained based on FIGS. 16 to 18.

Figure 16:
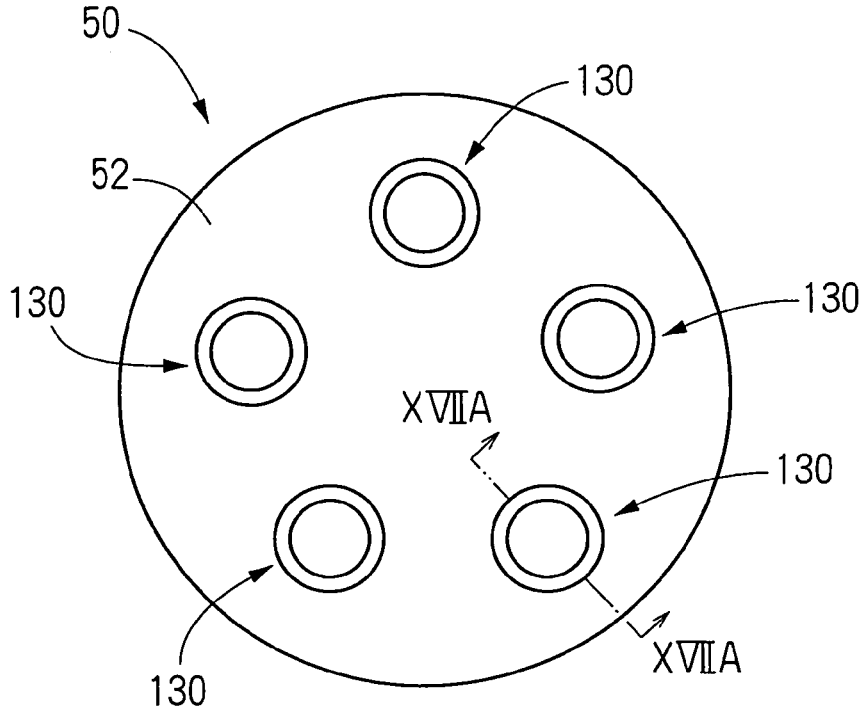
FIG. 16 is a diagram showing an injection hole plate of an injector according to a seventh embodiment.
Figure 17A:
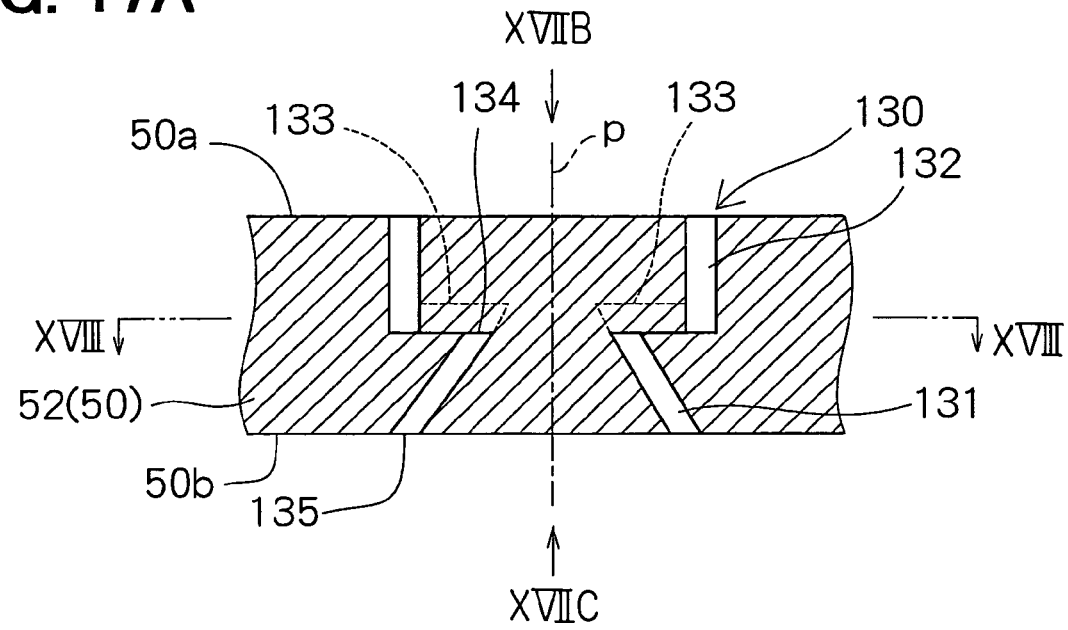
FIG. 17A is a sectional view showing the injection hole plate of FIG. 16 taken along the line XVIIA—XVIIA.

As shown in FIG. 16, multiple fuel injection portions 130 are formed in the injection hole plate 50 of the seventh embodiment. Each fuel injection portion 130 is formed with an injection hole 131, a communication hole 132 and a spiral passage hole 133 as shown in FIGS. 17A to 18. The injection hole 131 extends from an outlet side end 50*b* of the injection hole plate 50 to a depth within the injection plate 50. Accordingly, an inlet side opening 134 of the injection hole 131 is positioned inside the injection hole plate 50. The communication hole 132 extends from an inlet side end 50*a* of the injection hole plate 50 to the depth of the injection hole 131 in the thickness direction of the injection hole plate 50. The spiral passage hole 133 connects the injection hole 131 with the communication hole 132.

Figure 18:
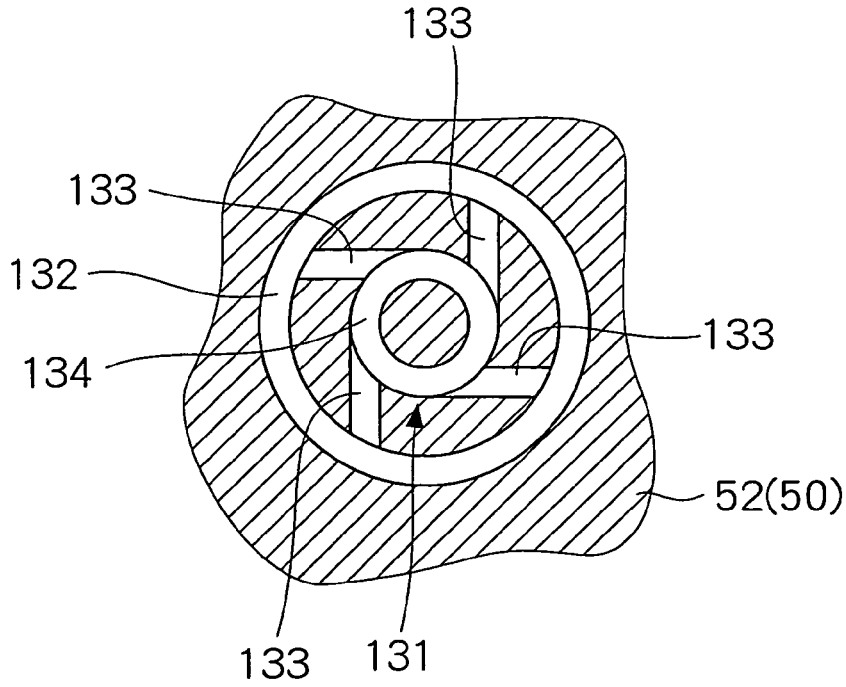
FIG. 18 is a sectional view showing the injection hole plate of FIG. 17A taken along the line XVIII—XVIII.

The inlet side opening 134 of the injection hole 131 is formed in the shape of a circular ring as shown in FIG. 18. An outlet side opening 135 of the injection hole 131 is formed in the shape of a circular ring as shown in FIG. 17C. The inlet side opening 134 and the outlet side opening 135 of the injection hole 131 respectively have major axes, which extend along a circumference of the injection hole 131, and minor axes, which extend perpendicularly to the major axes in radial directions of the injection hole 131. The injection hole 131 is formed in the shape of a circular ring and in the shape of a circular cone as shown in FIG. 17A. A distance between the injection hole 131 and a central axis p of the fuel injection portion 130 increases along a direction from the inlet side opening 134 to the outlet side opening 135. Therefore, the major axis of the inlet side opening 134 of the injection hole 131 is shorter than the major axis of the outlet side opening 135. A sectional area of the inlet side opening 134 of the injection hole 131 is smaller than the sectional area of the outlet side opening 135. A sectional area of the injection hole 131 gradually increases along the direction from the inlet side opening 134 to the outlet side opening 135.

Figure 17B:
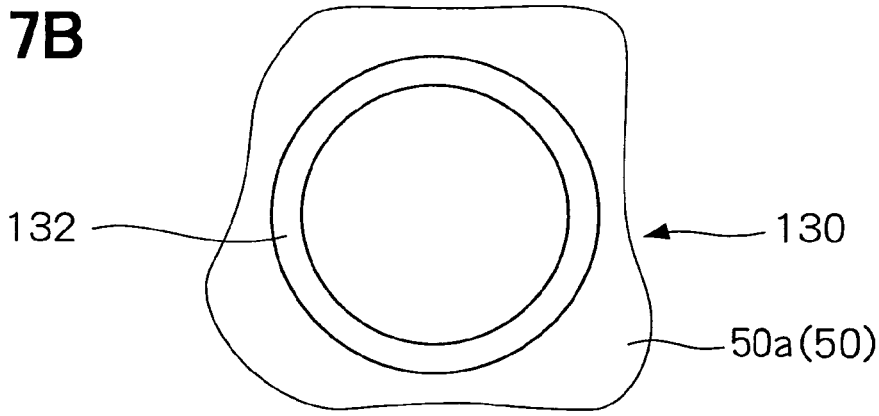
FIG. 17B is a diagram showing the injection hole plate of FIG. 17A along the arrow mark XVIIB.
Figure 17C:
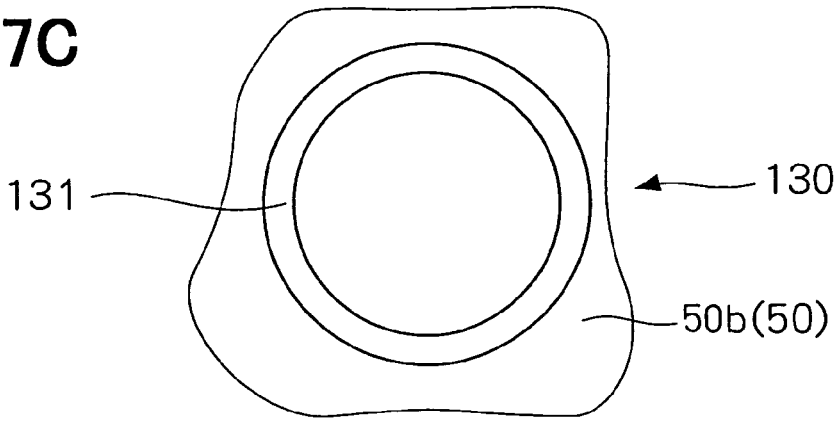
FIG. 17C is a diagram showing the injection hole plate of FIG. 17A along the arrow mark XVIIC.

The communication hole 132 is formed in the shape of a circular ring as shown in FIG. 17B. An end of the communication hole 132 on the spiral passage hole 133 side is positioned radially outside the inlet side opening 134 of the injection hole 131. The communication hole 132 is formed in the shape of a circular ring whose diameter is constant from the inlet side end 50*a* of the injection hole plate 50 to the depth of the injection hole 131 in the thickness direction of the injection hole plate 50. The inlet of the communication hole 132 opens into the inlet side end 50*a* of the injection hole plate 50. The outlet of the communication hole 132 is connected with the spiral passage holes 133. The spiral passage holes 133 connect the outlet of the communication hole 132 with the inlet side opening 134 of the injection hole 131. Each spiral passage hole 133 extends in a tangential direction of the inlet side opening 134 of the injection hole 131.

The fuel passing through an area between the valve body 41 and the needle 43 flows into the communication hole 132 opening into the inlet side end 50*a* of the injection hole plate 50. The fuel flowing into the communication hole 132 flows in an axial direction of the injection hole plate 50 along the communication hole 132. Then, the fuel flows into the inlet side opening 134 of the injection hole 131 from the outlet of the communication hole 132 through the spiral passage holes 133. Since the spiral passage hole 133 is formed in the tangential direction of the inlet side opening 134 of the injection hole 131, the fuel flowing into the inlet side opening 134 of the injection hole 131 from the spiral passage hole 133 rotates along a wall surface providing the injection hole 131. Thus, the fuel flowing into the inlet side opening 134 of the injection hole 131 flows toward the outlet side opening 135, while rotating along the wall surface of the injection hole 131.

In the seventh embodiment, the outlet side opening 135 of the injection hole 131 is formed in the shape of a flattened circular ring. Therefore, the fuel injected from the injection hole 131 forms a spray in the shape of a film. As a result, the atomization of the fuel is promoted.

Moreover, the multiple fuel injection portions 130 having the injection holes 131 are formed in the injection hole plate 50. Therefore, the fuel spray in a desired shape can be formed easily by adjusting the arrangement of the fuel injection portions 130.

Moreover, in the seventh embodiment, the fuel flows into the inlet side opening 134 of the injection hole 131 after flowing through the spiral passage holes 133, so the turning force is applied to the fuel. Therefore, the fuel flows from the inlet side opening 134 to the outlet side opening 135 of the injection hole 131 while rotating. As a result, the fuel injected from the injection hole 131 forms the spray in the shape of a film with the turning force. Thus, the atomization of the fuel is promoted further.

(Eighth Embodiment)

Next, an injection hole plate 50 as a first plate of an injector 10 according to the eighth embodiment will explained based on FIGS. 19 to 22.

Figure 19:
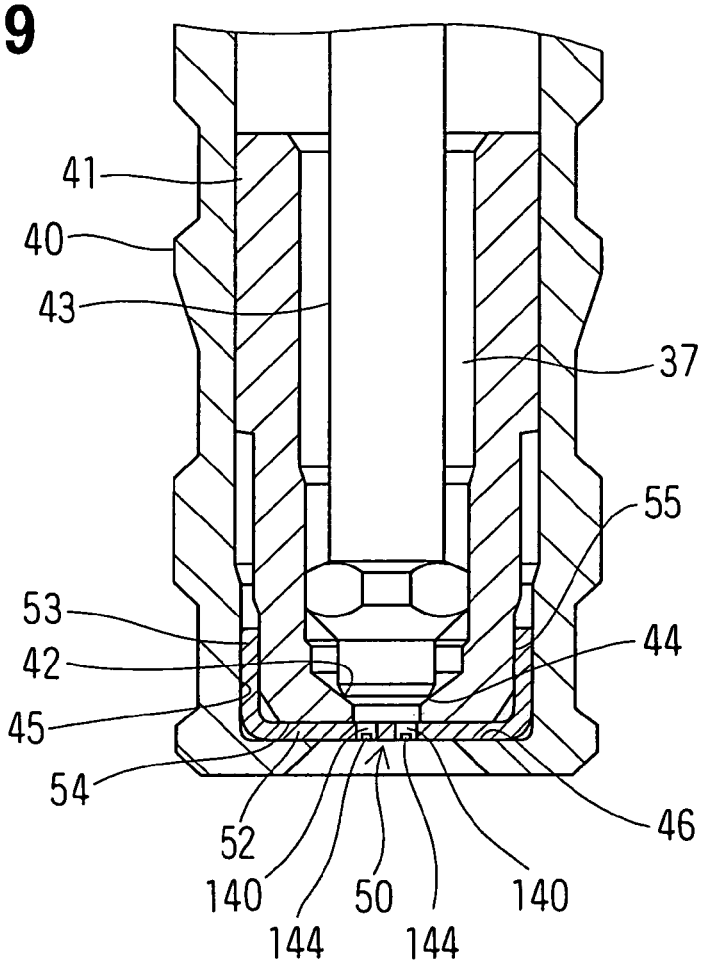
FIG. 19 is a sectional view showing a neighborhood of an injection hole of an injector according to an eighth embodiment of the present invention.
Figure 20:
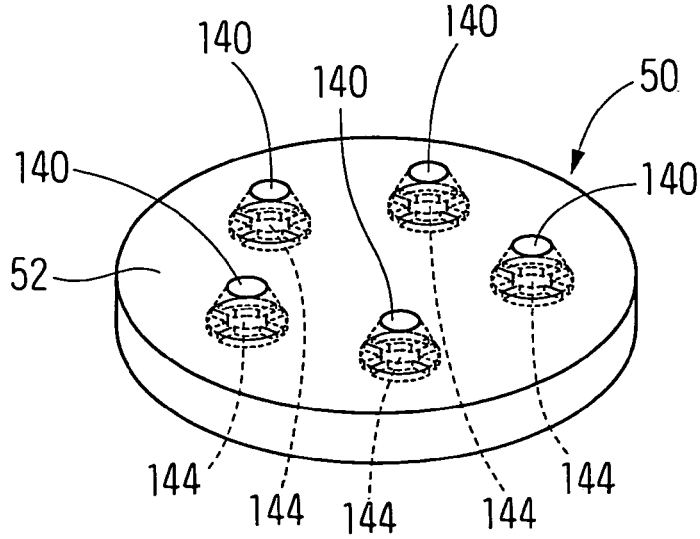
FIG. 20 is a perspective view showing a bottom portion of an injection hole plate of the injector according to the eighth embodiment.

The injection hole plate 50 of the eighth embodiment is formed in the shape of a cylinder with a bottom. More specifically, the injection hole plate 50 has a bottom portion 52 and a side portion 53 as shown in FIG. 19. The bottom portion 52 of the injection hole plate 50 is interposed between an outer wall surface 54 of the valve body 41 on a side opposite from the fixed core 12 and an inner wall surface 46 of the nozzle holder 40. The side portion 53 of the injection hole plate 50 is interposed between an outer peripheral wall surface 55 of the valve body 41 and an inner peripheral wall surface 45 of the nozzle holder 40. Multiple injection holes 140 are formed in the bottom portion 52 substantially on the same circumference as shown in FIG. 20.

Figure 21:
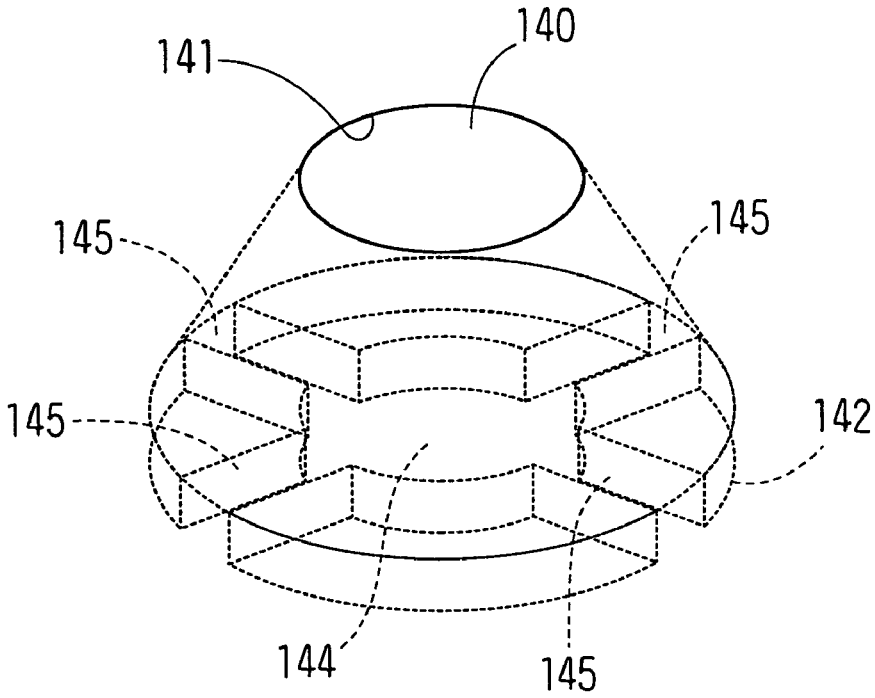
FIG. 21 is an enlarged perspective view showing the injection hole and a plate-like portion formed in the injection hole plate of the injector according to the eighth embodiment.

Plate-like portions 144 as colliding means are formed in the injection hole plate 50. More specifically, the injection hole plate 50 is formed with the injection holes 140 and the plate-like portions 144 as shown in FIG. 20. The plate-like portion 144 is disposed between a fuel inlet 141 and a fuel outlet 142 of the injection hole 140 as shown in FIG. 21. The injection hole 140 is formed along the thickness direction of the injection hole plate 50, or along the axial direction of the nozzle needle 43. The diameter of the fuel inlet 141 is smaller than that of the fuel outlet 142. Thus, the injection hole 140 is formed in the shape of a truncated cone whose internal diameter increases along a direction from the fuel inlet 141 to the fuel outlet 142. The plate-like portion 144 is formed near the fuel outlet 142 of the injection hole 140. The plate-like portion 144 is formed substantially perpendicularly to an axis of the injection hole 140. The plate-like portion 144 is connected with the injection hole plate 50 through holding portions 145 as shown in FIG. 21. The injection hole 140 and the plate-like portion 144 are formed through electrical discharge machining from at least one side of an end surface 50*a* on the fuel inlet 14 side and an end surface 50*b* on the fuel outlet 142 side of the injection hole plate 50.

The fuel flowing into the injection hole 140 through the fuel inlet 141 flows along the axial direction of the injection hole 140. Then, the fuel collides with the plate-like portion 144 formed near the fuel outlet 142 of the injection hole 140. Since the plate-like portion 144 is formed substantially perpendicularly to the axis of the injection hole 140, the fuel colliding with the plate-like portion 144 is broken into minute liquid droplets through the collision. Thus, the fuel is atomized in the injection hole 140 and flows out of the fuel outlet 142.

In the eighth embodiment, the plate-like portion 144 is formed between the fuel inlet 141 and the fuel outlet 142 of the injection hole 140. Therefore, the fuel flowing into the injection hole 140 collides with the plate-like portion 144. Then, the fuel is injected from the fuel outlet 142. The fuel is broken into minute liquid droplets when the fuel collides with the plate-like portion 144. Since the fuel collides with the plate-like portion 144, the kinetic energy of the fuel is converted into the atomization energy. As a result, the atomization of the fuel is promoted further.

Moreover, in the eighth embodiment, the plate-like portion 144 is formed substantially perpendicularly to the axis of the injection hole 140. Therefore, the fuel flowing into the injection hole 140 collides with the plate-like portion 144 surely. Thus, the energy of the fuel flowing into the injection hole 140 is converted into the atomization energy for atomizing the liquid droplets at a high efficiency. As a result, the atomization of the fuel is promoted.

Moreover, in the eighth embodiment, the injector 10 is used in the direct-injection type gasoline engine 1. The atomized fuel is injected into the combustion chamber 2 of the gasoline engine 1. Therefore, the combustion of the fuel is promoted, so the harmful matters included in the exhaust gas can be reduced.

Figure 22:
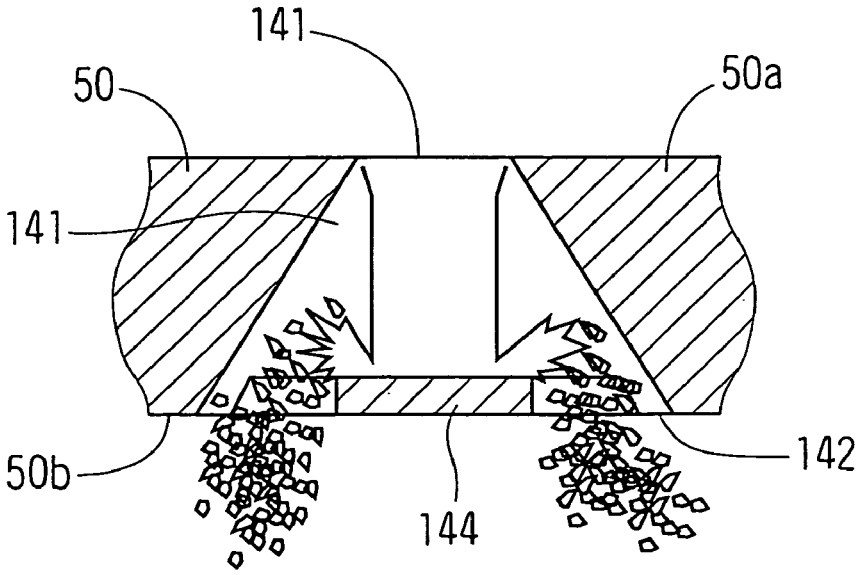
FIG. 22 is a sectional view showing the injection hole and the plate-like portion formed in the injection hole plate of the injector according to the eighth embodiment.

Moreover, in the eighth embodiment, the injection holes 140 are formed in the injection hole plate 50. Therefore, the fuel passing through the valve portion is divided into the multiple injection holes 140, so the atomization of the fuel is promoted. Moreover, the fuel flowing into the injection hole 140 is broken into minute liquid droplets by the plate-like portion 144 as shown in FIG. 22. As a result, the atomization of the fuel is promoted further. Moreover, control of the fuel spray is facilitated, since the plate-like portion 144 is provided.

(Ninth embodiment)

Next, an injector 10 according to the ninth embodiment will be explained based on FIGS. 23 to 25.

Figure 23:
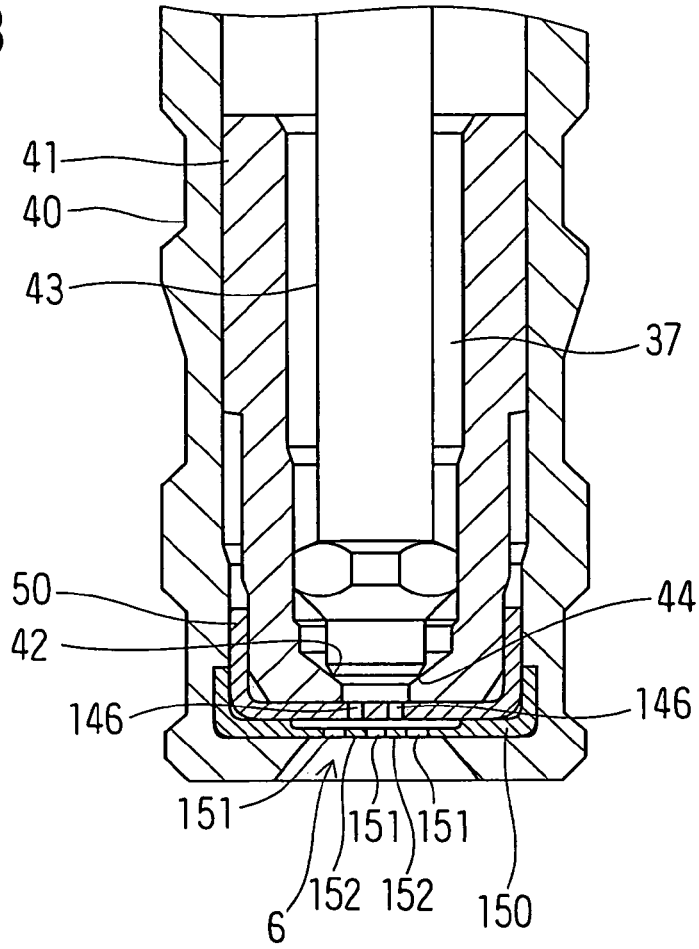
FIG. 23 is sectional view showing a neighborhood of an injection hole of an injector according to a ninth embodiment of the present invention.

In the ninth embodiment, a collision plate 150 as a second plate is interposed between the injection hole plate 50 and the nozzle holder 40 as shown in FIG. 23. More specifically, the collision plate 150 is disposed on a side of the injection hole plate 50 opposite from the valve body 41. The injection hole plate 50 and the collision plate 150 are disposed at a predetermined interval.

Figure 24:
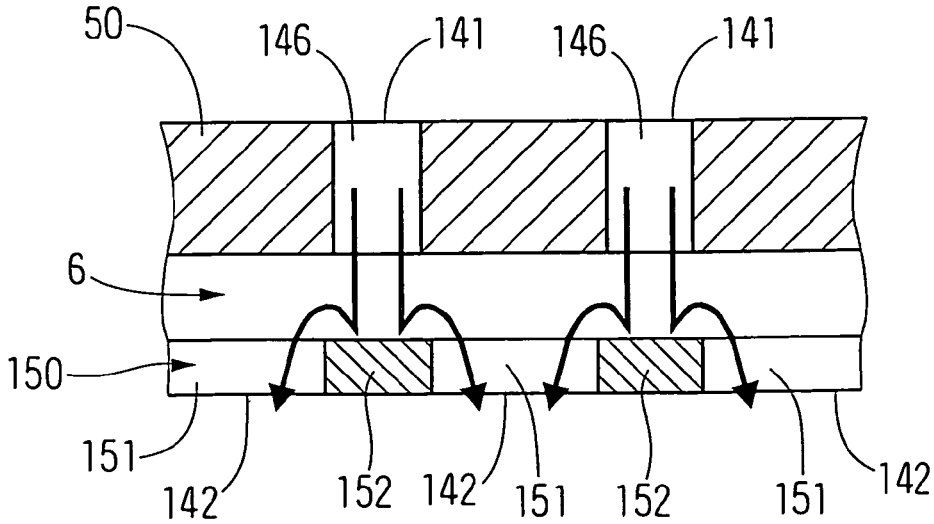
FIG. 24 is a sectional view showing an injection hole plate and a collision plate of the injector according to the ninth embodiment.
Figure 25:
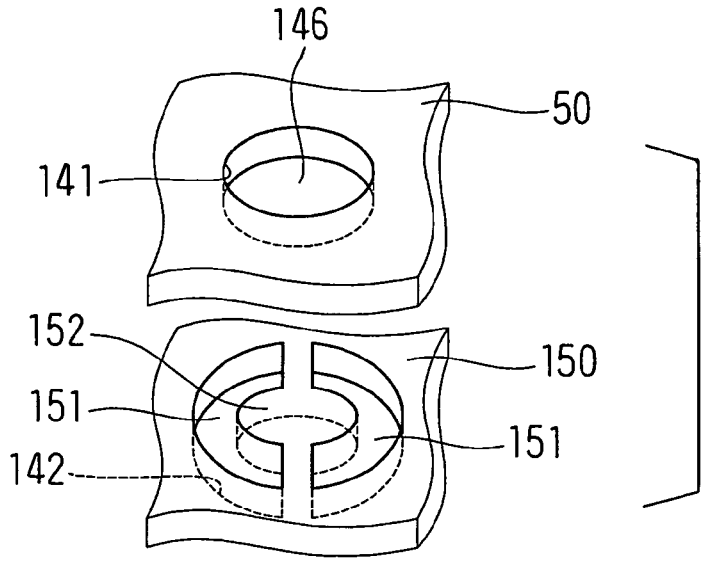
FIG. 25 is a perspective view showing the injection hole plate and the collision plate of the injector according to the ninth embodiment.

As shown in FIG. 24, holes 146 are formed in the injection hole plate 50. Holes 151 and plate-like portions 152 as colliding means are formed in the collision plate 150. In the ninth embodiment, an injection hole 6 is provided by the holes 146 of the injection hole plate 50 and the holes 151 of the collision plate 150. Therefore, fuel inlets 141 of the injection hole 6 are formed in the injection hole plate 50 and fuel outlets 142 of the injection hole 6 are formed in the collision plate 150.

Each plate-like portion 152 of the collision plate 150 is formed on the line extending from the hole 146 formed in the injection hole plate 50. The fuel flowing into the hole 146 of the injection hole plate 50 from the fuel inlet 141 collides with the plate-like portion 152 of the collision plate 150. Then, the fuel is injected from the fuel outlet 142 through the hole 151 of the collision plate 150.

In the ninth embodiment, the holes 151 and the plate-like portions 152 are formed in the collision plate 150. Therefore, only the holes 146 are required to be formed in the injection hole plate 50 as shown in FIG. 25. The plate-like portions 152 can be formed by forming the holes 151 in the collision plate 150. Therefore, only the holes 146, 151 are required to be formed in the injection hole plate 50 and the collision plate 150 respectively. Thus, the injection hole plate 50 and the collision plate 150 can be formed easily.

In the ninth embodiment, the fuel flowing from the fuel inlets 141 collides with the plate-like portions 152 of the collision plate 150. Thus, the fuel flowing into the injection hole 6 is broken into minute liquid droplets like the eighth embodiment. As a result, the atomization of the fuel is promoted further. Moreover, control of the fuel spray is facilitated owing to the plate-like portions 152.

(Tenth Embodiment)

Next, an injector 10 according to the tenth embodiment will be explained based on FIG. 26. The injector 10 of the tenth embodiment is a modified example of the ninth embodiment.

Figure 26:
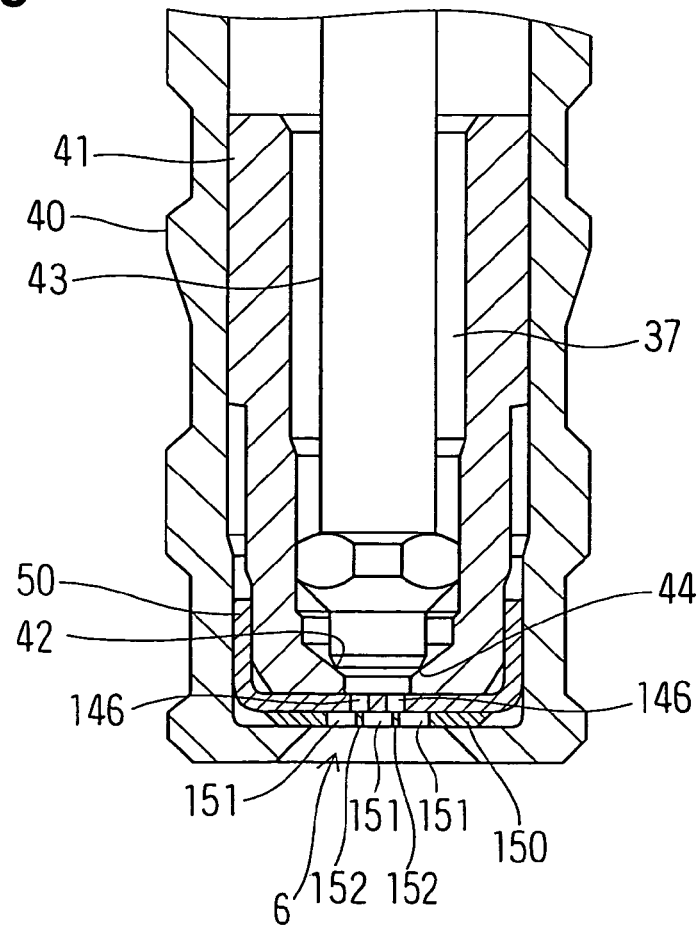
FIG. 26 is a sectional view showing an injection plate and a collision plate according to a tenth embodiment of the present invention.

In the tenth embodiment, as shown in FIG. 26, the injection hole plate 50 and the collision plate 150, which are formed separately, are joined and integrated with each other.

In the ninth embodiment, the injection hole plate 50 and the collision plate 150 are formed separately. Then, the injection hole plate 50 and the collision plate 150 are disposed at a predetermined interval as shown in FIGS. 23 and 24.

To the contrary, in the tenth embodiment, as shown in FIG. 26, the injection hole plate 50 and the collision plate 150 are joined and integrated with each other. In this case, the member provided by joining the injection hole plate 50 and the collision plate 150 has a structure similar to the eighth embodiment. Therefore, the atomization of the fuel is promoted like the eighth embodiment.

In the tenth embodiment, the single piece member is formed by joining the injection hole plate 50 with the collision plate 150, which are formed separately. Therefore, the injection hole plate 50 can be joined with the collision plate 150 after the holes 146, 151 are formed in the injection hole plate 50 and the collision plate 150, which are separate from each other. Therefore, the holes 146, 151 and the plate-like portions 152 can be formed easily.

(Eleventh Embodiment)

Next, an injector 10 according to the eleventh embodiment will be explained based on FIG. 27.

Figure 27:
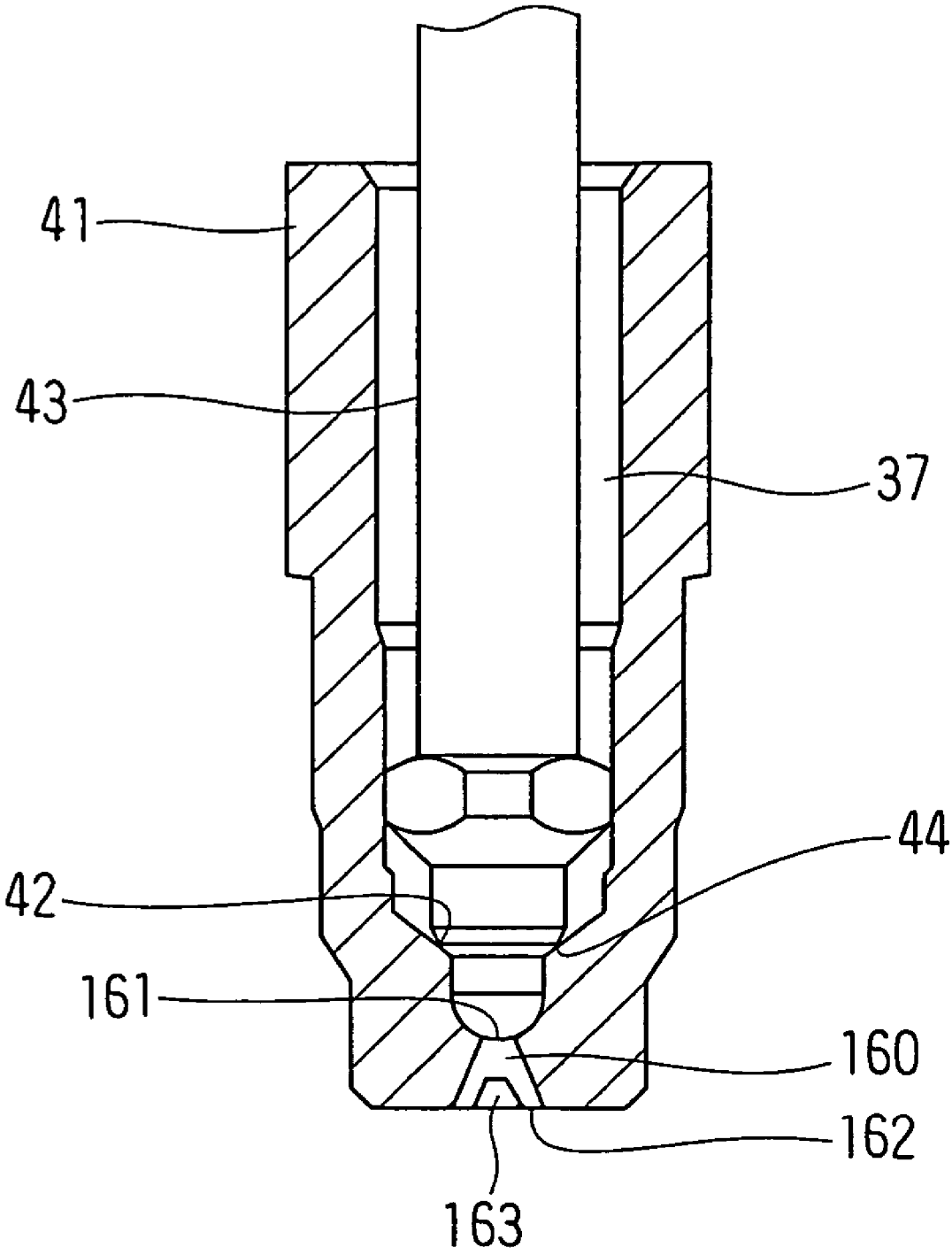
FIG. 27 is a sectional view showing a neighborhood of an injection hole of an injector according to an eleventh embodiment of the present invention.

In the eleventh embodiment, as shown in FIG. 27, injection holes 160 are formed in the valve body 41. The injection hole 160 connects a fuel outlet side of the valve portion, which is provided by the contacting portion 44 and the valve seat 42, with an outside of the valve body 41. A collision piece 163 as the colliding means is formed in the valve body 41. More specifically, in the eleventh embodiment, the injection holes 160 and the collision piece 163 are formed in the valve body 41. Thus, the fuel flowing into the injection hole 160 from the fuel inlet 161 collides with the collision piece 163. Then, the fuel is injected from the fuel outlet 162.

In the eleventh embodiment, the fuel is broken into minute liquid droplets through the collision with the collision piece 163. Therefore, the atomization of the fuel is promoted like the eighth embodiment.

Figure 2:
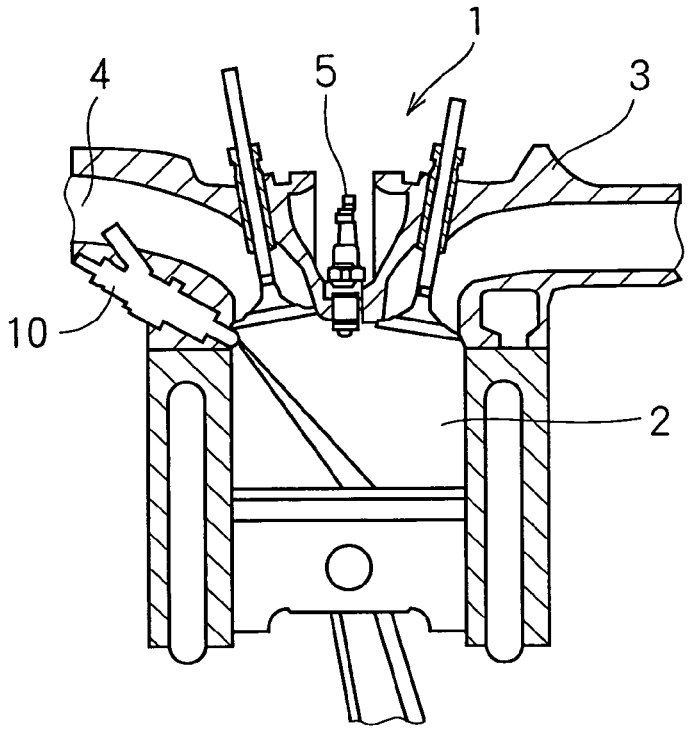
FIG. 2 is a sectional diagram showing a gasoline engine employing the injector according to the first embodiment.

In the eleventh embodiment, a separately formed injection hole plate or the like is not required. Therefore, the number of parts can be reduced. Moreover, compared to the case where the injection holes are formed in the injection hole plate, the wall thickness of the member around the injection hole 160 is increased. More specifically, since the injection holes 160 are formed in the valve body 41, the wall thickness of the valve body 41 increases around the injection holes 160. In the case where the injector 10 is mounted in the direct injection type gasoline engine 1, a portion of the injector 10 near the injection hole is exposed to the inside of the combustion chamber 2 as shown in FIG. 2. Therefore, the portion of the injector 10 near the injection hole is required to have strength enough to resist the high-temperature and high-pressure combustion. In the eleventh embodiment, the thickness of the valve body 41 around the injection holes 160 is increased. Therefore, the strength of the injector 10 near the injection holes 160 can be improved.

(Twelfth Embodiment)

Figure 28:
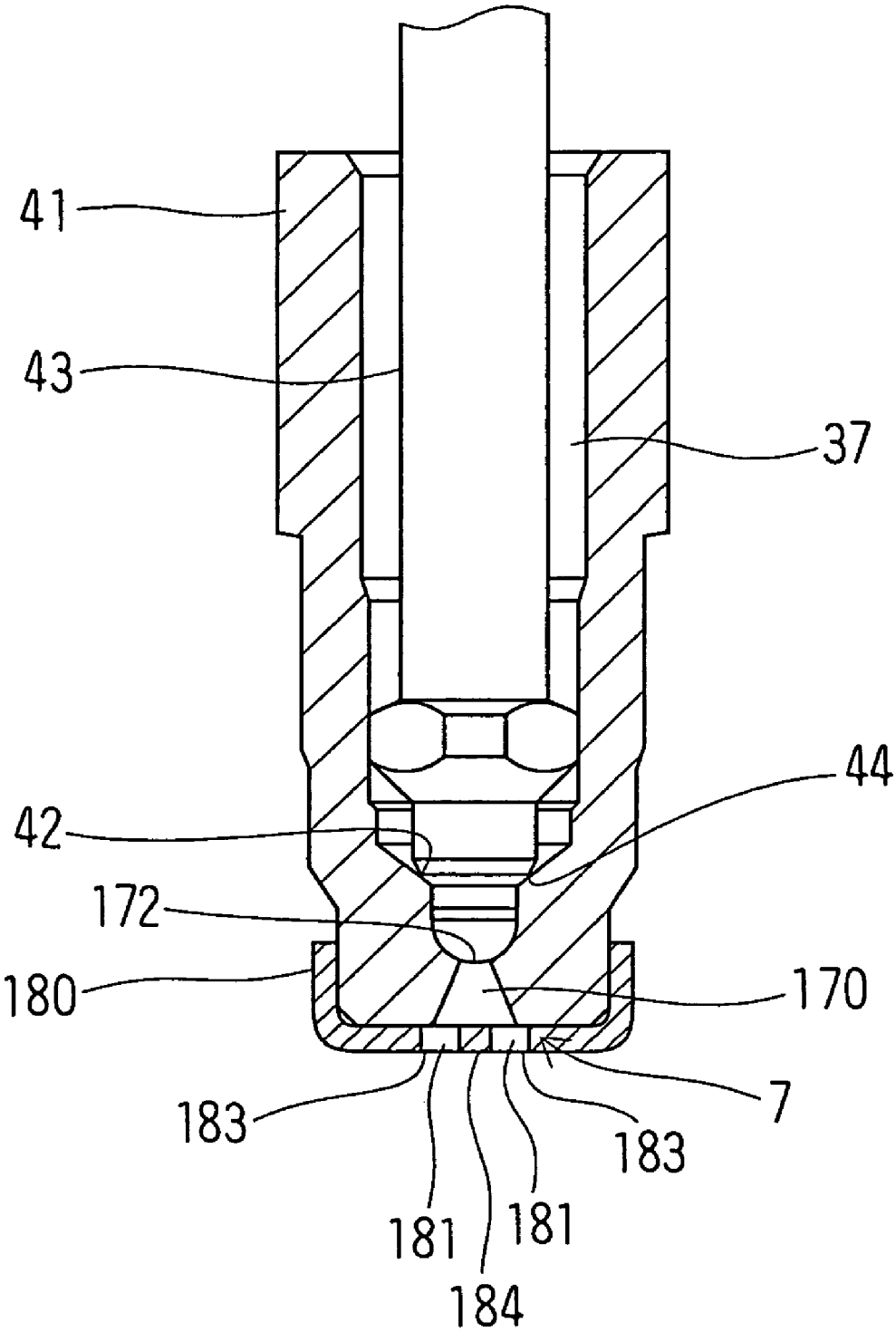
FIG. 28 is a sectional view showing a neighborhood of an injection hole of an injector according to a twelfth embodiment of the present invention.

Next, an injector 10 according to the twelfth embodiment will be explained based on FIG. 28.

In the twelfth embodiment, a plate member 180 as a third plate is disposed at the tip end of the valve body 41. In the twelfth embodiment, an injection hole 7 is provided by a hole 170 formed in the valve body 41 and holes 181 formed in the plate member 180. More specifically, a fuel inlet 172 of the injection hole 7 is formed in the valve body 41 and fuel outlets 183 are formed in the plate member 180. A plate-like portion 184 is formed in the plate member 180. The plate-like portion 184 is positioned on a line extending from the hole 170 formed in the valve body 41. The fuel flowing into the hole 170 of the valve body 41 from the fuel inlet 172 collides with the plate-like portion 184 of the plate member 180. Then, the fuel is injected from the fuel outlets 183 through the holes 181 of the plate member 180.

In the twelfth embodiment, only the holes 170, 181 are required to be formed in the valve body 41 and the plate member 180 respectively. Therefore, the valve body 41 and the plate member 180 can be formed easily.

In the twelfth embodiment, the fuel flowing into the hole 170 from the fuel inlet 172 collides with the plate-like portion 184 of the plate member 180. Therefore, the fuel is broken into minute droplets like the eleventh embodiment. As a result, the atomization of the fuel is promoted. Moreover, the control of the fuel spray is facilitated owing to the plate-like portion 184.

(Thirteenth Embodiment)

Next, an injection hole plate 190 of an injector 10 according to the thirteenth embodiment will be explained based on FIGS. 29 and 30.

Figure 29:
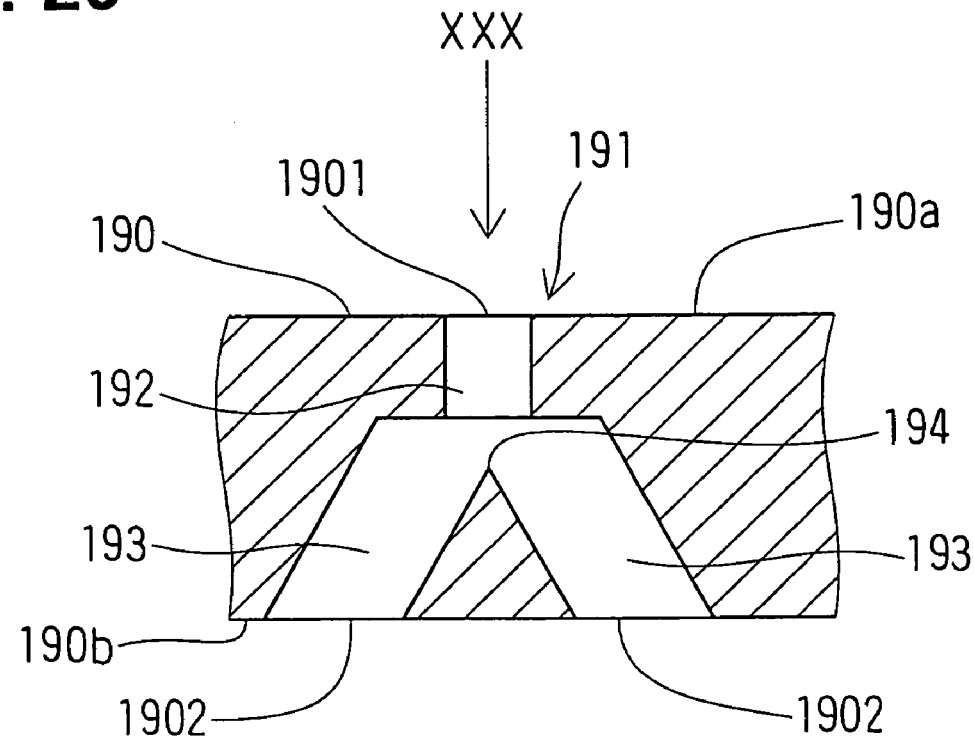
FIG. 29 is a sectional view showing an injection hole plate according to a thirteenth embodiment of the present invention.
Figure 30:
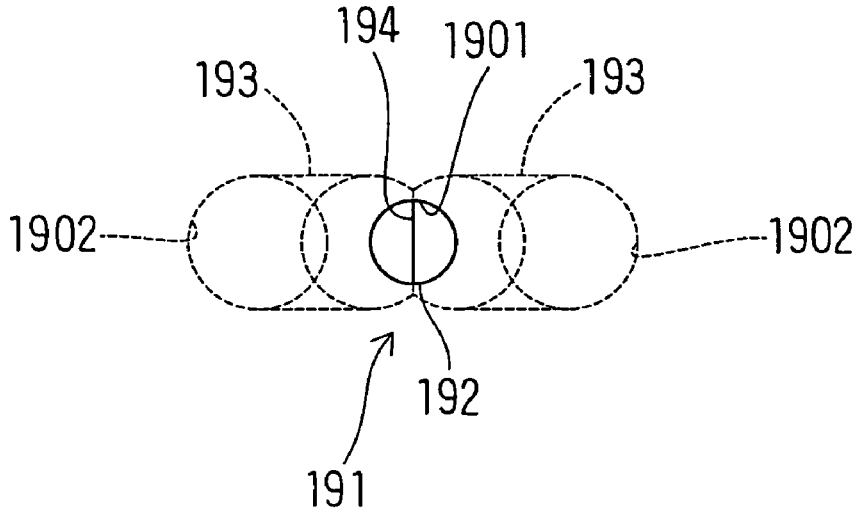
FIG. 30 is a diagram showing an injection hole of the injection hole plate of FIG. 29 along the arrow mark XXX.

In the thirteenth embodiment, the injection hole plate 190 as a first plate shown in FIGS. 29 and 30 is interposed between the valve body 41 and the nozzle holder 40. More specifically, the position of the injection hole plate 190 is the same as the eighth embodiment.

An injection hole 191 is formed in the injection hole plate 190. The injection hole 191 includes a main injection hole 192 and secondary injection holes 193 branching from the main injection hole 192. The fuel flows into the main injection hole 192 from a fuel inlet 1901. Then, the fuel passes through the secondary injection holes 193 and flows out of fuel outlets 1902. The main injection hole 192 is formed from an end surface 190*a* on the fuel inlet 1901 side of the injection plate 190 to a depth of the injection hole plate 190 in its thickness direction. The secondary injection holes 193 branch from an end of the main injection hole 192 on the fuel outlet 1902 side and extend to an end surface 190*b* of the injection hole plate 190 on the fuel outlet 1902 side.

In the thirteenth embodiment, the secondary injection holes 193 branch from the main injection hole 192 in two directions. Therefore, a peak portion 194 is formed at an intersection point between the main injection hole 192 and the secondary injection holes 193. The peak portion 194 is positioned substantially on an axis of the main injection hole 192. Therefore, the fuel flowing into the main injection hole 192 collides with the peak portion 194. Then, the fuel flows into the secondary injection holes 193. The fuel flowing into the main injection hole 192 is broken into minute liquid droplets through the collision with the peak portion 194. Thus, the peak portion 194 functions as the colliding means.

In the thirteenth embodiment, the fuel flowing into the main injection hole 192 flows into the secondary injection holes 193 after the fuel collides with the peak portion 194. The fuel is broken into minute liquid droplets when the fuel collides with the peak portion 194. Therefore, the kinetic energy of the fuel is converted into the atomization energy through the collision between the fuel and the peak portion 194. Therefore, the atomization of the fuel is promoted.

In the thirteenth embodiment, the main injection hole 192 can be formed from the end surface 190*a* of the injection hole plate 190 and the secondary injection holes 193 can be formed from the end surface 190*b*. The peak portion 194 can be formed at the intersection point between the main injection hole 192 and the secondary injection holes 193 by connecting the main injection hole 192 and the secondary injection holes 193 with each other. Therefore, the injection hole 191 provided by the main injection hole 192 and the secondary injection holes 193 and the peak portion 194 can be formed easily.

In the thirteenth embodiment, the secondary injection holes 193 branch into two directions from the main injection hole 192. Alternatively, the secondary injection holes 193 may branch into three or more directions from the main injection hole 192.

(Fourteenth Embodiment)

Next, an injection hole plate 200 of an injector 10 according to the fourteenth embodiment will be explained based on FIG. 31.

Figure 31:
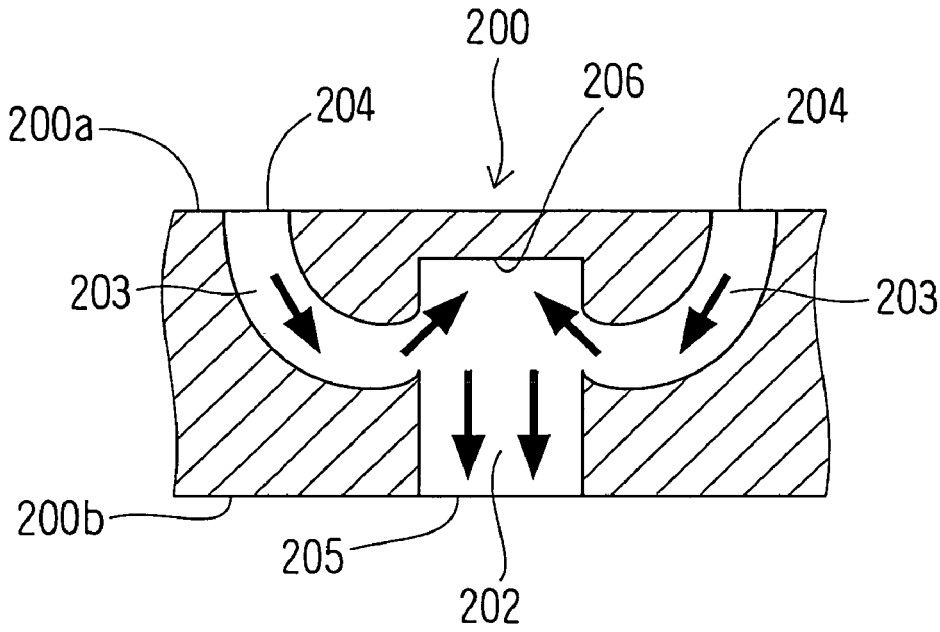
FIG. 31 is a sectional view showing an injection hole plate of an injector according to a fourteenth embodiment of the present invention.

In the fourteenth embodiment, the injection hole plate 200 as the first plate shown in FIG. 31 is interposed between the valve body 41 and the nozzle holder 40. More specifically, the position of the injection hole plate 200 is the same as the eighth embodiment.

An injection hole 201 is formed in the injection hole plate 200. The injection hole 201 is formed of a main injection hole 202 and communication holes 203. The fuel flows into the communication holes 203 from fuel inlets 204. Then, the fuel passes through the main injection hole 202 and is injected from a fuel outlet 205. The main injection hole 202 is formed from an end surface 200*b* of the injection hole plate 200 on a fuel outlet 205 side to a depth within the injection hole plate 200 along its thickness direction. Thus, a peak end surface 206 as colliding means is formed at an end of the main injection hole 202 on a side opposite from the fuel outlet 205. The communication holes 203 connect an end surface 200*a* of the injection hole plate 200 on the fuel inlet 204 side with the main injection hole 202. Each communication hole 203 is formed from the end surface 200*a* of the injection hole plate 200 on the fuel inlet 204 side toward the end surface 200*b* on the fuel outlet 205 side. Then, the communication hole 203 is bent toward the end surface 200*a* on the fuel inlet 204 side on the way. More specifically, the communication hole 203 is formed substantially in the shape of the letter "U" as shown in FIG. 31. Therefore, at the connected portion between the communication hole 203 and the main injection hole 202, the communication hole 203 is formed along the direction from the end surface 200*b* toward the end surface 200*a* of the injection hole plate 200.

The fuel flowing into the communication holes 203 from the fuel inlets 204 flows along the communication holes 203. More specifically, the fuel flowing from the end surface 200*a* side toward the end surface 200*b* side through the communication hole 203 is bent in the half way and is made to flow from the end surface 200*b* side toward the end surface 200*a* side. When the fuel flows from the communication hole 203 into the main injection hole 202, the fuel flows into the main injection hole 202 from the end surface 200*b* side. Therefore, the fuel flowing into the main injection hole 202 collides with the peak end surface 206 of the main injection hole 202. Then, the fuel is bent toward the end surface 200*b* again and flows toward the fuel outlet 205.

In the fourteenth embodiment, the fuel flowing into the main injection hole 202 from the communication holes 203 collides with the peak end surface 206 of the main injection hole 202. Then, the fuel passes through the main injection hole 202 and is injected from the fuel outlet 205. Since the fuel collides with the peak end surface 206, the fuel is broken into minute liquid droplets. Therefore, the kinetic energy of the fuel is converted into the atomization energy through the collision between the fuel and the peak end surface 206. Therefore, the atomization of the fuel is promoted.

Moreover, in the fourteenth embodiment, the flow direction of the fuel flowing into the communication hole 203 from the fuel inlet 204 is changed in the communication hole 203. Then, when the fuel collides with the peak end surface 206, the flow direction of the fuel is changed again. Therefore, the atomization of the fuel injected from the fuel outlet 205 is promoted and the flow velocity of the fuel injected from the fuel outlet 205 is reduced.

In the case of the direct injection type gasoline engine 1 shown in FIG. 2, the fuel is injected directly into the combustion chamber 2 from the injector 10. Therefore, there is a possibility that the injected fuel may adhere to an inner wall surface of the cylinder or a top end surface of the piston 3, which provide the combustion chamber 2. If the fuel adheres to the inner wall surface of the cylinder or the top end surface of the piston 3, the combustion of the fuel will be hindered and the smoke or unburned hydrocarbon components will be discharged from the engine. In the case of the direct injection type engine, the concentration of the fuel in the air-fuel mixture is low. Therefore, the fuel spray should preferably be formed near an ignition plug 5 shown in FIG. 2. Therefore, conventionally, a specific shape for bending the flow of the injected fuel toward the ignition plug 5 is formed on the top end surface of the piston 3. Accordingly, the shape of the engine becomes complicated.

To the contrary, in the fourteenth embodiment, the atomization of the fuel injected from the fuel outlet 205 shown in FIG. 31 is promoted and the flow velocity of the fuel is reduced. Accordingly, the spray is formed near the ignition plug 5. Therefore, the combustion of the fuel in the combustion chamber 2 can be promoted and the smoke or the unburned hydrocarbon components in the exhaust gas can be reduced without making the shape of the engine complicated.

Figure 32:
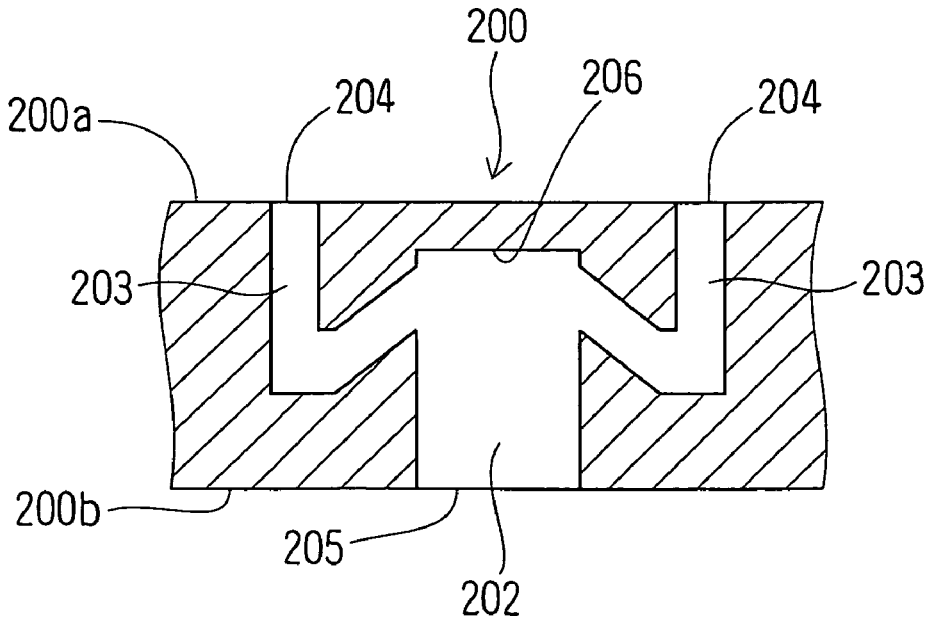
FIG. 32 is a sectional view showing an injection hole plate of an injector according to a modified example of the fourteenth embodiment.

In the fourteenth embodiment, the communication hole 203 is formed in the shape of the letter "U" as shown in FIG. 31. Alternatively, the communication hole 203 may be formed in the shape of the letter "V", as shown in FIG. 32.

(Fifteenth Embodiment)

Next, an injection hole plate 210 of an injector 10 according to the fifteenth embodiment will be explained based on FIG. 33.

Figure 33:
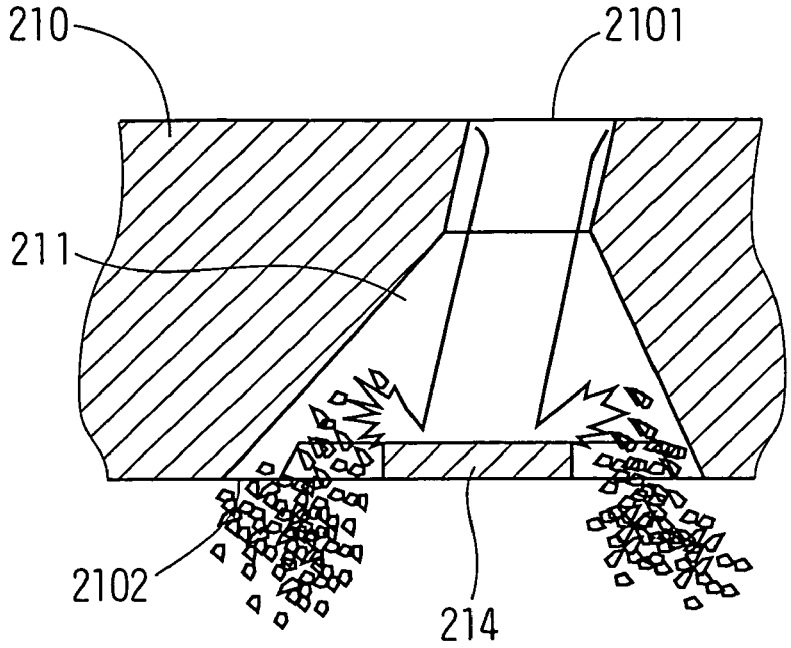
FIG. 33 is a sectional view showing an injection hole plate of an injector according to a fifteenth embodiment of the present invention.

In the fifteenth embodiment, an injection hole 211 is formed in the injection hole plate 210 as shown in FIG. 33. The injection hole 211 is formed so that a central axis of the injection hole 211 is inclined with respect to a thickness direction of the injection hole plate 210 by a predetermined angle. More specifically, the central axis of the injection hole 211 is inclined with respect to the central axis of the nozzle needle 43 by a predetermined angle.

In the fifteenth embodiment, even if the injection hole 211 is inclined with respect to the thickness direction of the injection hole plate 210, the fuel flowing into the injection hole 211 from a fuel inlet 2101 collides with a plate-like portion 214. Thus, the fuel flowing into the injection hole 211 is broken into minute liquid droplets. Thus, the atomization of the fuel is promoted. Moreover, the control of the fuel spray is facilitated owing to the plate-like portion 214. In the fifteenth embodiment, the injection hole 211 and the plate-like portion 214 are formed in the injection hole plate 210. Alternatively, the inclined injection hole may be formed in the valve body 41.

(Sixteenth Embodiment)

Figure 34:
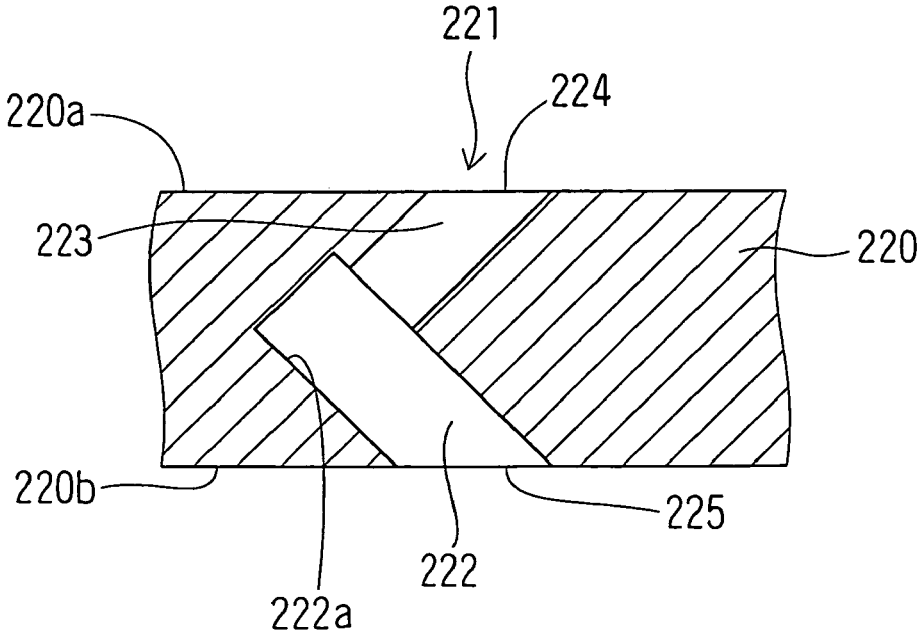
FIG. 34 is a sectional view showing an injection hole plate of an injector according to a sixteenth embodiment of the present invention.

Next, an injection hole plate 220 of an injector 10 according to the sixteenth embodiment will be explained based on FIG. 34. In the sixteenth embodiment, the injection hole plate 220 as the first plate shown in FIG. 34 is interposed between the valve body 41 and the nozzle holder 40.

An injection hole 221 is formed in the injection hole plate 220. The injection hole 221 is provided by a main injection hole 222 and a communication hole 223. The fuel flows into the communication hole 223 from a fuel inlet 224. Then, the fuel passes through the main injection hole 222 and is injected from a fuel outlet 225.

The main injection hole 222 is formed from an end surface 220*b* of the injection hole plate 220 on a fuel outlet 225 side to a depth within the injection hole plate 220. The communication hole 223 connects an end surface 220*a* of the injection hole plate 220 on a fuel inlet 224 side with the main injection hole 222. The main injection hole 222 and the communication hole 223 are inclined with respect to a thickness direction of the injection hole plate 220, or with respect to the axis of the nozzle needle 43. The central axis of the main injection hole 222 is inclined with respect to the central axis of the communication hole 223 by a predetermined angle. Thus, an end of the communication hole 223 on the main injection hole 222 side faces an inner wall surface 222*a* of the main injection hole 222. Thus, the inner wall surface 222*a* of the main injection hole 222 facing the end of the communication hole 223 on the main injection hole 222 side provides colliding means.

The fuel flowing into the communication hole 223 from the fuel inlet 214 flows into the main injection hole 222. The fuel flowing through the communication hole 223 flows straight along the axial direction of the communication hole 223 because of inertia, even when the fuel flows into the main injection hole 222. Therefore, the fuel flowing into the main injection hole 222 from the communication hole 223 collides with the inner wall surface 222*a*, which faces the communication hole 223. Thus, the flow direction of the fuel is changed into the axial direction of the main injection hole 222 after the fuel collides with the inner wall surface 222*a* of the main injection hole 222. Then, the fuel flows toward the fuel outlet 225.

In the sixteenth embodiment, the fuel flowing into the main injection hole 222 from the communication hole 223 collides with the inner wall surface 222*a* of the main injection hole 222. Then, the fuel passes through the main injection hole 222 and is injected from the fuel outlet 225. The fuel is broken into minute liquid droplets through the collision with the inner wall surface 222*a* of the main injection hole 222. Therefore, the kinetic energy of the fuel is converted into the atomization energy through the collision with the inner wall 222*a*. Thus, the atomization of the fuel is promoted.

In the sixteenth embodiment, the main injection hole 222 and the communication hole 223 are formed substantially perpendicularly to each other. Thus, the fuel flowing into the main injection hole 222 from the communication hole 223 collides with the inner wall surface 222*a* of the main injection hole 222 substantially perpendicularly. Therefore, the kinetic energy of the fuel can be converted into the atomization energy highly efficiently.

(Modifications)

In the above embodiments, the fuel injection hole may be formed at a slant with respect to the central axis of the valve body. Thus, the shape of the spray can be easily adjusted without changing the arrangement of the injection holes with respect to the injection hole plate.

The number of the injection holes or the injection hole groups formed of the multiple injection holes or the positions of the injection holes and the injection hole groups may be changed arbitrarily in accordance with the performance of the engine, to which the injector is mounted.

The injection holes may be formed directly in the valve body instead of the injection hole plate separated from the valve body.

The fuel inlet and the fuel outlet of the injection hole may be formed in any shapes such as a polygon including a triangle, a quadrangle or a star, an ellipse and the like. The colliding means formed between the fuel inlet and the fuel outlet may be formed in any shapes such as the polygon, the ellipse and the like. Moreover, the colliding means is not limited to the plat-like shape, but may be formed in the shape of a column.

The above embodiments may be used in any combinations.

The present invention should not be limited to the disclosed embodiments, but may be implemented in many other ways without departing from the spirit of the invention.

What is claimed is:

1. A fuel injection valve, comprising:

a valve body formed with a valve seat on an inner peripheral surface providing a fuel passage;

an injection hole plate, which is disposed in a downstream position of a flow of fuel with respect to the valve seat and is formed with a plurality of injection holes for injecting the fuel flowing through the fuel passage; and a valve member for stopping the fuel injection through the injection holes when the valve member is seated on the valve seat and for allowing the fuel injection through the injection holes when the valve member is separated from the valve seat, wherein each injection hole is formed with an inlet side opening on a valve seat side and an outlet side opening on a side opposite from the valve seat so that at least the outlet side opening is formed in a flattened shape having a major axis and a minor axis, each injection hole is formed so that a major axis of the inlet side opening is shorter than the major axis of the outlet side opening and so that a minor axis of the inlet side opening is not shorter than the minor axis of the outlet side opening, and each injection hole is formed so that a sectional area thereof gradually changes along a direction from the inlet side opening to the outlet side opening.

2. The fuel injection valve as in claim 1, wherein each injection hole is formed so that a section thereof perpendicular to a central axis thereof is formed in the shape of a rectangle.

3. The fuel injection valve as in claim 1, wherein each injection hole is formed so that a section thereof perpendicular to a central axis thereof is formed in the shape of an ellipse.

4. The fuel injection valve as in claim 1, wherein each injection hole is formed so that the minor axis of the inlet side opening is longer than the minor axis of the outlet side opening.

5. The fuel injection valve as in claim 1, wherein the injection hole plate is formed with at least one injection hole group formed of at least two of the plurality of injection holes.

6. The fuel injection valve as in claim 5, wherein the injection hole plate is formed with a plurality of injection hole groups along a circumference of the valve body.

7. The fuel injection valve as in claim 1, wherein each injection hole is formed around a virtual axis parallel to a central axis of the valve body.

8. The fuel injection valve as in claim 1, wherein each injection hole is formed at a slant with respect to a central axis of the valve body.

9. The fuel injection valve as in claim 1, wherein the plurality of injection holes, are formed substantially in the shape of a truncated cone as a whole and are formed in the shape of arcs disposed on a circumference of a circle or circumferences of concentric circles substantially at an interval.

10. The fuel injection valve as in claim 1, wherein; the injection hole plate is formed with a plurality of injection hole groups formed of the plurality of injection holes, and the plurality of injection holes for each injection hole group are formed substantially in the shape of a truncated cone as a whole and are formed in the shape of arcs disposed on a circumference of a circle substantially at an interval.

11. The fuel injection valve as in claim 1, wherein; the injection hole plate is formed with each injection hole formed from an end of the injection hole plate on a side opposite from the valve body to a depth within the injection hole plate toward the other end of the injection hole plate on the valve body side, the injection hole plate is formed with a communication hole, which is formed from the end of the injection hole plate on the valve body side to the depth of each injection hole along a thickness direction of the injection hole plate toward the end on the side opposite from the valve body and is formed radially outside the inlet side opening of each injection hole, and the injection hole plate is formed with a spiral passage hole, which connects the communication hole with the inlet side opening of each injection hole and extends in a tangential direction of the inlet side opening.

12. The fuel injection valve as in claim 1, wherein each injection hole is formed so that the minor axis of the inlet side opening is substantially the same as the minor axis of the outlet side opening.

13. A fuel injection valve, comprising:

a valve body formed with a valve seat on an inner peripheral surface providing a fuel passage and with a plurality of injection holes for injecting fuel flowing through the fuel passage, the injection holes being disposed in a downstream position of a flow of the fuel with respect to the valve seat; and a valve member for stopping the fuel injection through the injection holes when the valve member is seated on the valve seat and for allowing the fuel injection through the injection holes when the valve member is separated from the valve seat, wherein each injection hole is formed with an inlet side opening on a valve seat side and an outlet side opening on a side opposite from the valve seat so that at least the outlet side opening is formed in a flattened shape having a major axis and a minor axis, each injection hole is formed so that a major axis of the inlet side opening is shorter than the major axis of the outlet side opening and so that a minor axis of the inlet side opening is not shorter than the minor axis of the outlet side opening, and each injection hole is formed so that a sectional area thereof gradually changes along a direction from the inlet side opening to the outlet side opening.

14. The fuel injection valve as in claim 13, wherein each injection hole is formed so that a section thereof perpendicular to a central axis thereof is formed in the shape of a rectangle.

15. The fuel injection valve as in claim 13, wherein each injection hole is formed so that a section thereof perpendicular to a central axis thereof is formed in the shape of an ellipse.

16. The fuel injection valve as in claim 13, wherein each injection hole is formed so that the minor axis of the inlet side opening is longer than the minor axis of the outlet side opening.

17. The fuel injection valve as in claim 13, wherein the valve body is formed with at least one injection hole group formed of at least two of the plurality of injection holes.

18. The fuel injection valve as in claim 17, wherein the valve body is formed with a plurality of injection hole groups along a circumference of the valve body.

19. The fuel injection valve as in claim 13, wherein each injection hole is formed around a virtual axis parallel to a central axis of the valve body.

20. The fuel injection valve as in claim 13, wherein each injection hole is formed at a slant with respect to a central axis of the valve body.

21. The fuel injection valve as in claim 13, wherein each injection hole is formed so that the minor axis of the inlet side opening is substantially the same as the minor axis of the outlet side opening.

22. An injection hole plate of a fuel injection valve including a valve body formed with a valve seat on an inner peripheral surface thereof and a valve member for stopping injection of fuel through injection holes formed in the injection hole plate when the valve member is seated on the valve seat and for allowing the fuel injection through the injection holes when the valve member is separated from the valve seat, the injection hole plate being disposed in a downstream position of the flow of the fuel with respect to the valve seat, wherein each injection hole is formed with an inlet side opening on a valve seat side and an outlet side opening on a side opposite from the valve seat so that at least the outlet side opening is formed in a flattened shape having a major axis and a minor axis, each injection hole is formed so that a major axis of the inlet side opening is shorter than the major axis of the outlet side opening and so that a minor axis of the inlet side opening is not shorter than the minor axis of the outlet side opening, and each injection hole is formed so that a sectional area thereof gradually changes along a direction from the inlet side opening to the outlet side opening.

23. The injection hole plate as in claim 22, wherein each injection hole is formed so that a section thereof perpendicular to a central axis thereof is formed in the shape of a rectangle.

24. The injection hole plate as in claim 22, wherein each injection hole is formed so that a section thereof perpendicular to a central axis thereof is formed in the shape of an ellipse.

25. The injection hole plate as in claim 22, wherein each injection hole is formed so that the minor axis of the inlet side opening is longer than the minor axis of the outlet side opening.

26. The injection hole plate as in claim 22, wherein the injection hole plate is formed with at least one injection hole group formed of at least two of the injection holes.

27. The injection hole plate as in claim 26, wherein the injection hole plate is formed with a plurality of injection hole groups disposed along a circumference of the valve body.

28. The injection hole plate as in claim 22, wherein each injection hole is formed around a virtual axis parallel to a central axis of the valve body.

29. The injection hole plate as in claim 22, wherein each injection hole is formed at a slant with respect to a central axis of the valve body.

30. The injection hole plate as in claim 22, wherein the plurality of injection holes are formed substantially in the shape of a truncated cone as a whole and are formed in the shape of arcs disposed on a circumference of a circle or circumferences of concentric circles substantially at an interval.

31. The injection hole plate as in claim 22, wherein;

the injection hole plate is formed with a plurality of injection hole groups formed of the injection holes, and the injection holes for each injection hole group are formed substantially in the shape of a truncated cone as a whole and are formed in the shape of arcs disposed on a circumference of a circle substantially at an interval.

32. The injection hole plate as in claim 22, wherein; the injection hole plate is formed with each injection hole formed from an end of the injection hole plate on a side opposite from the valve body to a depth within the injection hole plate toward the other end of the injection hole plate on the valve body side, the injection hole plate is formed with a communication hole, which is formed from the end of the injection hole plate on the valve body side to the depth of each injection hole along a thickness direction of the injection hole plate toward the end on the side opposite from the valve body and is formed radially outside the inlet side opening of each injection hole, and the injection hole plate is formed with a spiral passage hole, which connects the communication hole with the inlet side opening of each injection hole and extends in a tangential direction of the inlet side opening.

33. The injection hole plate as in claim 22, wherein each injection hole is formed so that the minor axis of the inlet side opening is substantially the same as the minor axis of the outlet side opening.

34. A valve body of a fuel injection valve including a valve member, which stops fuel injection through injection holes formed in the valve body when the valve member is seated on a valve seat formed on an inner peripheral surface of the valve body and allows the fuel injection through the injection holes when the valve member is separated from the valve seat, the injection holes being disposed in a downstream position of a flow of the fuel with respect to the valve seat, wherein each injection hole is formed with an inlet side opening on a valve seat side and an outlet side opening on a side opposite from the valve seat so that at least the outlet side opening is formed in a flattened shape having a major axis and a minor axis, each injection hole is formed so that a major axis of the inlet side opening is shorter than the major axis of the outlet side opening and so that a minor axis of the inlet side opening is not shorter than the minor axis of the outlet side opening, and each injection hole is formed so that a sectional area thereof gradually changes along a direction from the inlet side opening to the outlet side opening.

35. The valve body as in claim 34, wherein each injection hole is formed so that a section thereof perpendicular to a central axis thereof is formed in the shape of a rectangle.

36. The valve body as in claim 34, wherein each injection hole is formed so that a section of the injection hole perpendicular to a central axis thereof is formed in the shape of an ellipse.

37. The valve body as in claim 34, wherein each injection hole is formed so that the minor axis of the inlet side opening is longer than the minor axis of the outlet side opening.

38. The valve body as in claim 34, wherein the valve body is formed with at least one injection hole group formed of at least two of the injection holes.

39. The valve body as in claim 38, wherein the valve body is formed with a plurality of injection hole groups along a circumference of the valve body.

40. The valve body as in claim 34, wherein each injection hole is formed around a virtual axis parallel to a central axis of the valve body.

41. The valve body as in claim 34, wherein each injection hole is formed at a slant with respect to a central axis of the valve body.

42. The valve body as in claim 34, wherein each injection hole is formed so that the minor axis of the inlet side opening is substantially the same as the minor axis of the outlet side opening.

* * * * *